US008609313B2

(12) United States Patent
Eida et al.

(10) Patent No.: US 8,609,313 B2
(45) **Date of Patent: *Dec. 17, 2013**

(54) TONER AND METHOD FOR PRODUCING TONER

(75) Inventors: Akihiro Eida, Wakayama (JP); Shogo Watanabe, Wakayama (JP); Takashi Kubo, Wakayama (JP)

(73) Assignee: Kao Corporation, Tokyo (JP)

( * ) Notice: Subject to any disclaimer, the term of this patent is extended or adjusted under 35 U.S.C. 154(b) by 171 days.

This patent is subject to a terminal disclaimer.

(21) Appl. No.: 13/107,330

(22) Filed: May 13, 2011

(65) Prior Publication Data

US 2011/0294062 A1 Dec. 1, 2011

(30) Foreign Application Priority Data

May 28, 2010 (JP) ..... 2010-123206

(51) Int. Cl.
*G03G 9/087* (2006.01)

(52) U.S. Cl.
USPC ..... 430/109.3; 430/109.4; 430/137.1; 430/137.18

(58) Field of Classification Search
USPC ..... 430/137.1, 109.4, 137.18, 137.2, 109.3
See application file for complete search history.

(56) References Cited

U.S. PATENT DOCUMENTS

| | | | |
|---|---|---|---|
| 7,312,011 | B2 | 12/2007 | Patel et al. |
| 8,153,343 | B2 | 4/2012 | Kubo et al. |
| 8,216,757 | B2 | 7/2012 | Mizutani et al. |
| 2007/0207401 | A1 | 9/2007 | Shirai |
| 2009/0123863 | A1 | 5/2009 | Ashizawa et al. |
| 2011/0045402 | A1 | 2/2011 | Eida et al. |
| 2011/0212395 | A1 * | 9/2011 | Aoki et al. ..... 430/108.1 |

FOREIGN PATENT DOCUMENTS

| | | | |
|---|---|---|---|
| CN | 1808290 | A | 7/2006 |
| CN | 101470366 | A | 7/2009 |
| CN | 101650538 | A | 2/2010 |
| JP | 4-81770 | A | 3/1992 |
| JP | 2003-246920 | A | 5/2003 |
| JP | 2005-308995 | A | 11/2005 |
| JP | 2009-116175 | A | 5/2009 |
| JP | 2010-139659 | A | 6/2010 |
| JP | 2011-065129 | A | 3/2011 |
| WO | WO-2010-050023 | A1 * | 5/2010 |
| WO | WO 2010/067884 | A2 | 6/2010 |

OTHER PUBLICATIONS

Chinese Office Action for Application No. 201110138211.8 dated Aug. 19, 2013.

* cited by examiner

*Primary Examiner* — Janis L Dote
(74) *Attorney, Agent, or Firm* — Birch, Stewart, Kolasch & Birch, LLP

(57) ABSTRACT

A toner containing a resin binder and a colorant, wherein the resin binder contains a crystalline resin and an amorphous resin, the crystalline resin containing a composite resin containing: a polycondensation resin component obtained by polycondensing an alcohol component containing an aliphatic diol having 2 to 10 carbon atoms, and a carboxylic acid component containing an aromatic dicarboxylic acid compound, and a styrenic resin component, and the amorphous resin containing a polyester obtained from an alcohol component containing an aliphatic diol in an amount of 60% by mol or more, and a carboxylic acid component. The toner of the present invention is suitably used in, for example, the development of a latent image formed in electrophotography, electrostatic recording method, electrostatic printing method or the like.

6 Claims, No Drawings

TONER AND METHOD FOR PRODUCING TONER

FIELD OF THE INVENTION

The present invention relates to a toner, which is used in, for example, the development of a latent image formed in electrophotography, electrostatic recording method, electrostatic printing method or the like, and a method for producing such a toner.

BACKGROUND OF THE INVENTION

For the demands of speeding-up, miniaturization, and the like in the recent years, a toner that is capable of being fixed at an even lower temperature is in demand. In order to meet such a demand, a toner in which a resin binder containing a crystalline resin and an amorphous resin is used is proposed. While a toner in which a crystalline resin and an amorphous resin are used as described above has improved low-temperature fixing ability, the toner described above is likely to have a lowered toner strength. As a result, since a toner is applied with a larger mechanical or thermal stress to meet the demands of the speeding-up and miniaturization, a disadvantage concerning the lowering of durability such as storage stability is generated.

In view of the above disadvantages, it is disclosed that a toner containing a polyester resin containing a composite of a crystalline polyester obtained by polycondensing an alcohol component containing an aliphatic diol having 2 to 6 carbon atoms in an amount of 80% by mol or more, and an aliphatic dicarboxylic acid component having 2 to 8 carbon atoms in an amount of 80% by mol or more; and an amorphous polyester obtained by polycondensing an aliphatic diol having 2 to 6 carbon atoms in an amount of 20% by mol or more and a carboxylic acid component has excellent low-temperature fixing ability and storage stability, and also has excellent color reproducibility (see JP-A-2003-246920).

In addition, it is disclosed that a toner containing a resin binder containing a block copolymer or a graft copolymer obtained by chemically bonding 3 to 50 parts by weight of a crystalline polyester and 97 to 50 parts by weight of an ionically cross-linked amorphous vinyl polymer, wherein a chloroform-insoluble content is from 3 to 10% by weight of the copolymer has excellent offset resistance and low-temperature fixing ability (see JP-A-Hei-4-81770).

Further, a method for producing a toner including the steps of melt-kneading a crystalline polyester and an amorphous resin, and heat-treating a melt-kneaded mixture to obtain a toner which satisfies all of low-temperature fixing ability, storage property, and durability is proposed (see JPA-2005-308995 (US-A-2007/207401) and JP-A-2009-116175 (US-A-2009/116175)).

SUMMARY OF THE INVENTION

The present invention relates to:

[1] a toner containing a resin binder and a colorant, wherein the resin binder contains a crystalline resin and an amorphous resin, the crystalline resin containing a composite resin containing:

a polycondensation resin component obtained by polycondensing an alcohol component containing an aliphatic diol having 2 to 10 carbon atoms, and a carboxylic acid component containing an aromatic dicarboxylic acid compound, and a styrenic resin component, and the amorphous resin containing a polyester obtained from an alcohol component containing an aliphatic diol in an amount of 60% by mol or more, and a carboxylic acid component; and

[2] a method for producing a toner including the steps of:

(1) melt-kneading at least a resin binder and a colorant to provide a kneaded product; and (2) heat-treating the kneaded product obtained in the step (1), wherein the resin binder contains a crystalline resin and an amorphous resin, the crystalline resin containing a composite resin containing:

a polycondensation resin component obtained by polycondensing an alcohol component containing an aliphatic diol having 2 to 10 carbon atoms, and a carboxylic acid component containing an aromatic dicarboxylic acid compound, and a styrenic resin component, and the amorphous resin containing a polyester obtained from an alcohol component containing an aliphatic diol in an amount of 60% by mol or more, and a carboxylic acid component.

DETAILED DESCRIPTION OF THE INVENTION

Conventional toners have some disadvantages that the toners are insufficient in satisfaction of both low-temperature fixing ability and storage stability, and have poor initial rise in triboelectric charging, so that a difference in triboelectric charges between the initial charging and after a given time period passed is likely to be caused, thereby generating unevenness in optical density. In addition, there are some disadvantages that a heat treatment for a long period of time would be necessitated in order to improve storage stability, thereby lowering productivity.

The present invention relates to a toner having excellent low-temperature fixing ability and excellent storage stability, and suppressed unevenness in optical density, and a method for producing such a toner, and a method for producing a toner having a shorter time period for a heat-treating step, thereby having high productivity.

The toner of the present invention exhibits some effects of having excellent low-temperature fixing ability, and having suppressed unevenness in optical density, and an effect of having excellent storage stability. Further, the method of the present invention is a method for producing a toner having shorter time period for a heat-treating step, thereby having a high productivity.

These and other advantages of the present invention will be apparent from the following description.

The toner of the present invention has a great feature in that the toner is a toner containing at least a resin binder and a colorant, wherein the resin binder contains a crystalline resin and an amorphous resin, the crystalline resin containing a composite resin containing:

a polycondensation resin component obtained by polycondensing an alcohol component containing an aliphatic diol having 2 to 10 carbon atoms, and a carboxylic acid component containing an aromatic dicarboxylic acid compound, and a styrenic resin component, and the amorphous resin containing a polyester obtained from an alcohol component containing an aliphatic diol in an amount of 60% by mol or more, and a carboxylic acid component.

The toner of the present invention has excellent low-temperature fixing ability and storage stability, and suppressed unevenness in optical density.

In addition, the method for producing a toner of the present invention has a great feature in that the method includes the steps of:

(1) melt-kneading at least a resin binder and a colorant to provide a kneaded product; and (2) heat-treating the kneaded product obtained in the step 1, wherein the resin binder contains a crystalline resin and an amorphous resin, the crystalline resin containing a composite resin containing:

a polycondensation resin component obtained by polycondensing an alcohol component containing an aliphatic diol having 2 to 10 carbon atoms, and a carboxylic acid component containing an aromatic dicarboxylic acid compound, and a styrenic resin component, and the amorphous resin containing a polyester obtained from an alcohol component containing an aliphatic diol in an amount of 60% by mol or more, and a carboxylic acid component.

The method for producing a toner of the present invention is a method for producing a toner with a shorter time period for a heat-treating step, thereby having a high productivity.

The detailed reasons why the effects of the present invention are exhibited are not elucidated. Although not wanting to be limited by theory, it is presumably due to the fact that since the alcohol component of the amorphous polyester contains an aliphatic alcohol in an amount of 60% by mol or more, steric hindrance and electrostatic interactions become smaller, so that intermolecular interactions are lowered, thereby making it likely to recover crystallinity of a crystalline resin that is broken down by melt-kneading. Further, since a composite resin containing a styrenic resin component is used as a crystalline resin, the compatibility between the amorphous polyester and the crystalline resin is lowered, so that the formation of the phase separation structure with the amorphous polyester is accelerated upon heat treatment, thereby increasing crystallization rate. Therefore, the time period for a heat-treating step is shortened, so that productivity is improved, and the resulting toner has excellent storage stability.

In addition, the amorphous polyester from an aromatic alcohol contains an aromatic ring which more easily retain electric charges in a large amount, so that triboelectric charges of the toner increase with the time passed for rubbing, so that a difference in triboelectric charges between the initial charging and after a given time period passed is generated, thereby making it likely to cause unevenness in optical density. On the other hand, an amorphous polyester from an aliphatic alcohol has a low concentration of the aromatic ring, so that electric charges are more likely to be leaked. For this reason, the triboelectric charges at the initial stage is lowered, thereby making it likely to cause unevenness in optical density. However, since an amorphous polyester obtained from an alcohol component containing an aliphatic diol in an amount of 60% by mol and a carboxylic acid component, and a crystalline composite resin containing a styrenic resin component containing an aromatic ring, and a polycondensation resin component obtained by polycondensing an alcohol component containing an aliphatic diol having 2 to 10 carbon atoms and a carboxylic acid component containing an aromatic dicarboxylic acid compound, are used together, triboelectric charges and electroconductivity become appropriate, so that unevenness in optical density is suppressed.

In the present invention, the resin binder is composed of a crystalline resin and an amorphous resin, from the viewpoint of improvements in low-temperature fixing ability and storage stability of the toner, and from the viewpoint of suppression of unevenness in optical density of the toner, and it is preferable that the crystalline resin contains a composite resin as a main component, which contains a polycondensation resin component obtained by polycondensing an alcohol component containing an aliphatic diol having 2 to 10 carbon atoms and a carboxylic acid component containing an aromatic dicarboxylic acid compound, and a styrenic resin component, and that the amorphous resins contains, as a main component, a polyester obtained from an alcohol component containing an aliphatic diol in an amount of 60% by mol or more and a carboxylic acid component.

Here, the crystallinity of the resin is expressed by a crystallinity index defined by a value of a ratio of a softening point to a temperature of maximum endothermic peak determined by a scanning differential calorimeter, i.e. softening point/temperature of maximum endothermic peak. The crystalline resin is a resin having a crystallinity index of from 0.6 to 1.4, preferably from 0.7 to 1.2, and more preferably from 0.9 to 1.2, and the amorphous resin is a resin having a crystallinity index exceeding 1.4 or less than 0.6. The crystallinity of the resin can be adjusted by the kinds of the raw material monomers, a ratio thereof, production conditions (for example, reaction temperature, reaction time, cooling rate), and the like. Here, the temperature of maximum endothermic peak refers to a temperature of the peak on the highest temperature side among endothermic peaks observed. When a difference between the temperature of maximum endothermic peak and the softening point is within 20° C., the temperature of maximum endothermic peak is defined as a melting point. When the difference between the temperature of maximum endothermic peak and the softening point exceeds 20° C., the peak is a peak temperature ascribed to a glass transition.

In the present invention, the polycondensation resin component constituting the composite resin is a resin obtained by polycondensing an alcohol component containing an aliphatic diol having 2 to 10 carbon atoms and a carboxylic acid component containing an aromatic dicarboxylic acid compound, from the viewpoint of improvements in storage stability and low-temperature fixing ability of the toner, and suppression of unevenness in optical density of the toner.

The polycondensation resin component includes polyesters, polyester-polyamides, and the like, and the polyesters are preferred, from the viewpoint of low-temperature fixing ability of the toner.

In the present invention, the alcohol component of the polycondensation resin component contains an aliphatic diol having 2 to 10 carbon atoms, preferably 4 to 8 carbon atoms, and more preferably 4 to 6 carbon atoms, from the viewpoint of enhancement of crystallinity of the composite resin.

The aliphatic diol having 2 to 10 carbon atoms includes ethylene glycol, 1,2-propylene glycol, 1,3-propylene glycol, 1,4-butanediol, 1,5-pentanediol, 1,6-hexanediol, 1,7-heptanediol, 1,8-octanediol, 1,9-nonanediol, neopentyl glycol, 1,4-butenediol, and the like. Especially, from the viewpoint of enhancement of crystallinity of the composite resin, the $\alpha,\omega$-linear alkanediol is preferred, 1,4-butanediol and 1,6-hexanediol are more preferred, and 1,6-hexanediol is even more preferred.

The aliphatic diol having 2 to 10 carbon atoms is contained in an amount of preferably 70% by mol or more, more preferably from 80 to 100% by mol, and even more preferably from 90 to 100% by mol, of the alcohol component, from the viewpoint of enhancement of crystallinity of the composite resin. Especially, a proportion of one kind of the aliphatic diol having 2 to 10 carbon atoms occupying the alcohol component is preferably 50% by mol or more, more preferably from 60 to 100% by mol, and even more preferably substantially 100%, of the alcohol component.

The alcohol component may contain a polyhydric alcohol component other than the aliphatic diol having 2 to 10 carbon atoms, and the polyhydric alcohol component includes aromatic diols such as an alkylene oxide adduct of bisphenol A, represented by the formula (I):

(I)

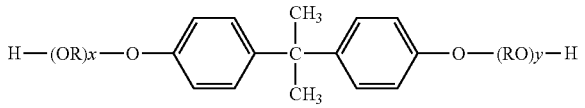

wherein RO and OR are an oxyalkylene group, wherein R is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4; and trihydric or higher polyhydric alcohols such as glycerol, pentaerythritol, trimethylolpropane, sorbitol, and 1,4-sorbitan.

In the present invention, the carboxylic acid component of the polycondensation resin component contains an aromatic dicarboxylic acid compound, from the viewpoint of enhancement of crystallinity of the composite resin, and from the viewpoint of suppression of unevenness in optical density of the toner.

The aromatic dicarboxylic acid compound is preferably those having 8 to 12 carbon atoms, including aromatic dicarboxylic acids, such as phthalic acid, isophthalic acid, and terephthalic acid, and acid anhydrides thereof and alkyl (1 to 8 carbon atoms) esters thereof. Here, the dicarboxylic acid compound refers to a dicarboxylic acid, an acid anhydride thereof, and an alkyl (1 to 8 carbon atoms) ester thereof, among which the dicarboxylic acids are preferred. In addition, the preferred number of carbon atoms means the number of carbon atoms of the dicarboxylic acid moiety of the dicarboxylic acid compound.

The aromatic dicarboxylic acid compound is contained in an amount of preferably from 70 to 100% by mol, more preferably from 90 to 100% by mol, and even more preferably substantially 100% by mol, of the carboxylic acid component, from the viewpoint of enhancement of crystallinity of the composite resin, and from the viewpoint of suppression of unevenness in optical density of the toner.

The carboxylic acid component may contain a polycarboxylic acid compound other than the aromatic dicarboxylic acid compound. The polycarboxylic acid compound includes aliphatic dicarboxylic acids, such as oxalic acid, malonic acid, maleic acid, fumaric acid, citraconic acid, itaconic acid, glutaconic acid, succinic acid, adipic acid, and succinic acids substituted with an alkyl group having 1 to 30 carbon atoms or an alkenyl group having 2 to 30 carbon atoms; alicyclic dicarboxylic acids such as cyclohexanedicarboxylic acid; aromatic, tricarboxylic or higher polycarboxylic acids, such as trimellitic acid, 2,5,7-naphthalenetricarboxylic acid, and pyromellitic acid; acid anhydrides thereof, and alkyl(1 to 8 carbon atoms) esters thereof.

Here, the alcohol component may properly contain a monohydric alcohol, and the carboxylic acid component may properly contain a monocarboxylic acid compound, from the viewpoint of adjusting the molecular weight and the like.

Here, in the present specification, a dually reactive monomer described later is not counted to be included in the amount of the alcohol component or the carboxylic acid component contained.

The total number of moles of the aromatic dicarboxylic acid compound and the aliphatic diol having 2 to 10 carbon atoms is preferably from 75 to 100% by mol, more preferably from 85 to 100% by mol, and even more preferably from 95 to 100% by mol, of the total number of moles of the raw material components of the polycondensation resin component, i.e. the carboxylic acid component and the alcohol component, from the viewpoint of enhancement of crystallinity of the composite resin.

As to the molar ratio of the carboxylic acid component to the alcohol component in the polycondensation resin component, i.e. carboxylic acid component/alcohol component, in order to achieve a larger molecular weight of the composite resin, it is preferable that the proportion of the alcohol component is greater than the carboxylic acid component, and the molar ratio is more preferably from 0.50 to 0.89, and even more preferably from 0.70 to 0.85.

The polycondensation reaction of the raw material monomers for the polycondensation resin component can be carried out by polymerizing the raw material monomers in an inert gas atmosphere at a temperature of from 180° to 250° C. or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter that can be used together with the esterification catalyst includes gallic acid, and the like. The esterification catalyst is used in an amount of preferably from 0.01 to 1.5 parts by weight, and more preferably from 0.1 to 1.0 part by weight, based on 100 parts by weight of a total amount of the alcohol component, the carboxylic acid component, and the dually reactive monomer component. The esterification promoter is used in an amount of preferably from 0.001 to 0.5 parts by weight, and more preferably from 0.01 to 0.1 parts by weight, based on 100 parts by weight of a total amount of the alcohol component, the carboxylic acid component, and the dually reactive monomer component.

As the raw material monomers for the styrenic resin component, styrene or styrene derivatives such as α-methylstyrene and vinyltoluene (hereinafter, the styrene and styrene derivatives are collectively referred to as "styrenic derivatives") are used.

The styrenic derivative is contained in an amount of preferably 70% by weight or more, more preferably 80% by weight or more, and even more preferably 90% by weight or more, of the raw material monomers for the styrenic resin component, from the viewpoint of improvement in storage stability of the toner, and from the viewpoint of suppression of unevenness in optical density of the toner.

The raw material monomers for the styrenic resin component that are usable other than the styrenic derivative include alkyl (meth)acrylate ester; ethylenically unsaturated monoolefins, such as ethylene and propylene; diolefins such as butadiene; halovinyls such as vinyl chloride; vinyl esters such as vinyl acetate and vinyl propionate; ethylenically monocarboxylate esters such as dimethylaminoethyl (meth) acrylate; vinyl ethers such as vinyl methyl ether; vinylidene halides such as vinylidene chloride; N-vinyl compounds such as N-vinylpyrrolidone; and the like.

The raw material monomers for the styrenic resin component that are usable other than the styrenic derivative can be used in a combination of two or more kinds. The term "(meth) acrylic acid" as used herein means acrylic acid and/or methacrylic acid.

Among the raw material monomers for the styrenic resin component that are usable other than the styrenic derivative, the alkyl (meth)acrylate ester is preferred, from the viewpoint of improvement in low-temperature fixing ability of the toner. The alkyl group in the alkyl (meth)acrylate ester has preferably 1 to 22 carbon atoms, and more preferably 8 to 18 carbon atoms, from the viewpoint mentioned above. Here, the number of carbon atoms of the alkyl ester refers to the number of carbon atoms derived from the alcohol component moiety constituting the ester.

Specific examples of the alkyl (meth)acrylate ester includes methyl (meth)acrylate, ethyl (meth)acrylate, (iso) propyl (meth)acrylate, 2-hydroxyethyl (meth)acrylate, (iso or tert)butyl (meth)acrylate, 2-ethylhexyl (meth)acrylate, (iso) octyl (meth)acrylate, (iso)decyl (meth)acrylate, (iso)stearyl (meth)acrylate, and the like. Here, the expression "(iso or tert)" or "(iso)" embrace both a case where these groups are present and a case where the groups are absent, and the case where the groups are absent means normal. Also, the expression "(meth)acrylate" means that both cases of acrylate and methacrylate are included.

The alkyl (meth)acrylate ester is contained in an amount of preferably 30% by weight or less, more preferably 20% by weight or less, and even more preferably 10% by weight or less, of the raw material monomers for the styrenic resin component, from the viewpoint of improvement in storage stability of the toner, and from the viewpoint of suppression of unevenness in optical density of the toner.

Here, a resin obtained by addition polymerization of raw material monomers containing a styrenic derivative and an alkyl (meth)acrylate ester is also referred to as styrene-(meth) acrylate resin.

The addition polymerization reaction of the raw material monomers for the styrenic resin component can be carried out by a conventional method, for example, a method of carrying out the reaction of the raw material monomers in the presence of a polymerization initiator such as dicumyl peroxide, a crosslinking agent, and the like in an organic solvent or without any solvents. The temperature conditions are preferably from 110° to 200° C., and more preferably from 140° to 170° C.

When an organic solvent is used upon the addition polymerization reaction, xylene, toluene, methyl ethyl ketone, acetone, or the like can be used. It is preferable that the organic solvent is used in an amount of from 10 to 50 parts by weight or so, based on 100 parts by weight of the raw material monomers for the styrenic resin component.

The styrenic resin component has a glass transition temperature (Tg) of preferably from 60° to 130° C., more preferably from 80° to 120° C., and even more preferably from 90° to 110° C., from the viewpoint of improvement in low-temperature fixing ability and improvement in storage stability of the toner.

As to Tg of the styrenic resin component, a value obtained by a calculation based on Tgn of a homopolymer of each of the monomers constituting each polymer, in accordance with Fox formula (T. G. Fox, *Bull. Am. Physics Soc.,* 1(3), 123 (1956)), an empirical formula for predicting Tg by a thermal additive formula in a case of a polymer, is used as calculated from the following formula (1):

$$1/Tg=\Sigma(Wn/Tgn) \quad (1)$$

wherein Tgn is Tg expressed in absolute temperature for a homopolymer of each of the monomer components; and Wn is a weight percentage of each of the monomer components.

The dually reactive monomer described later as used herein is assumed not to be counted in the calculation for the amount of the styrenic resin component contained, and not included in the calculation for Tg of the styrenic resin component.

In the calculation of the glass transition temperature (Tg) according to the Fox formula usable in Examples of the present invention, Tgn of styrene of 373K (100° C.) and Tgn of 2-ethylhexyl acrylate of 223K (−50° C.) are used It is preferable in the composite resin that the polycondensation resin component and the styrenic resin component are bonded directly or via a linking group. The linking group includes dually reactive monomers described later, compounds derived from chain transfer agents, and other resins, and the like.

The composite resin is preferably in a state that the polycondensation resin component and the styrenic resin component mentioned above are dispersed in each other, and the dispersion state mentioned above can be evaluated by a difference between Tg of the composite resin measured by the method described in Examples and a calculated value according to the above Fox formula.

In other words, while the composite resin in the present invention is a crystalline resin, the composite resin contains an amorphous portion derived from the styrenic resin component and the polycondensation resin component, so that the composite resin has a Tg ascribed to the styrenic resin component and a Tg ascribed to the polycondensation resin component. The Tg of the styrenic resin component and the Tg of the polycondensation resin component in the composite resin are values found separately. The higher the degree of dispersion of the styrenic resin component and the polycondensation resin component, the more approximate the both Tg values to each other; therefore, when the styrenic resin component and the polycondensation resin component are dispersed into a nearly homogenous state, both the Tg's overlap, and the found values would be nearly one.

Therefore, in the state where the styrenic resin component and the polycondensation resin component are dispersed in each other, the Tg of the composite resin measured under the measurement conditions described later takes a value different from a Tg calculated according to the Fox formula for the styrenic resin component mentioned above. Specifically, the absolute value of a difference in a glass transition temperature of the composite resin and a glass transition temperature of the styrenic resin component of the composite resin calculated according to Fox formula is preferably 10° C. or more, more preferably 30° C. or more, even more preferably 50° C. or more, and even more preferably 70° C. or more. In general, since the polycondensation resin component has a Tg lower than Tg of the styrenic resin component, the found values for the Tg of the composite resin may be lower than calculated values of Tg of the styrenic resin in many cases.

The composite resin as describe above can, for example, be obtained by:

(1) a method including the step of polycondensing raw material monomers for a polycondensation resin component in the presence of a styrenic resin having a carboxyl group or a hydroxyl group, wherein the carboxyl group or the hydroxyl group includes those derived from a dually reactive monomer or a chain transfer agent described later;

(2) a method including the step of subjecting raw material monomers for a styrenic resin component to addition polymerization in the presence of a polycondensation resin having a reactive unsaturated bond; or the like.

It is preferable that the composite resin is a resin obtained from the raw material monomers for the polycondensation resin component and the raw material monomers for the styrenic resin component, and further a dually reactive monomer, capable of reacting with both of the raw material monomers for the polycondensation resin component and the raw material monomers for the styrenic resin component (hybrid resin), from the viewpoint of improvement in low-temperature fixing ability and improvement in storage stability of the toner, and from the viewpoint of suppression of unevenness in optical density of the toner. Therefore, upon the polymerization of the raw material monomers for the polycondensation resin component and the raw material monomers for the styrenic resin component to obtain a composite resin, it is preferable that the polycondensation reaction and/or the addition polymerization reaction is carried out in the presence of the dually reactive monomer. By inclusion of the dually reactive monomer, the composite resin is a resin formed by binding the polycondensation resin component and the styrenic resin component via a constituting unit derived from the dually reactive monomer (hybrid resin), in which the polycondensation resin component and the styrenic resin component are more finely and homogeneously dispersed.

Specifically, it is preferable that the composite resin is a resin obtained by polymerizing:

(i) raw material monomers for a polycondensation resin component, containing an alcohol component containing an aliphatic diol having 2 to 10 carbon atoms and a carboxylic acid component containing an aromatic dicarboxylic acid compound;

(ii) raw material monomers for a styrenic resin component; and (iii) a dually reactive monomer capable of reacting with both of the raw material monomers for the polycondensation resin component and the raw material monomers for the styrenic resin component.

It is preferable that the dually reactive monomer is a compound having in its molecule at least one functional group selected from the group consisting of a hydroxyl group, a carboxyl group, an epoxy group, a primary amino group and a secondary amino group, preferably a carboxyl group and/or a hydroxyl group, and more preferably a carboxyl group, and an ethylenically unsaturated bond. By using the dually reactive monomer described above, dispersibility of the resin forming a dispersion phase can be even more improved. It is preferable that the dually reactive monomer is at least one member selected from the group consisting of acrylic acid, methacrylic acid, fumaric acid, maleic acid, and maleic anhydride. It is more preferable that the dually reactive monomer is acrylic acid, methacrylic acid, or fumaric acid, from the viewpoint of reactivities of the polycondensation reaction and the addition polymerization reaction. Here, in a case where a polymerization inhibitor is used together with the dually reactive monomer, a polycarboxylic acid having an ethylenically unsaturated bond, such as fumaric acid, functions as raw material monomers for the polycondensation resin component. In this case, fumaric acid or the like is not a dually reactive monomer but a raw material for a polycondensation resin component.

From the viewpoint of enhancement of dispersibility of the styrenic resin component and the polycondensation resin component, improvement in low-temperature fixing ability and improvement in storage stability of the toner, and from the viewpoint of suppression of unevenness in optical density of the toner, the dually reactive monomer is used in an amount of preferably from 1 to 30 mol, more preferably from 2 to 25 mol, and even more preferably from 2 to 20 mol, based on 100 mol of a total of the alcohol component of the polycondensation resin component, and the dually reactive monomer is used in an amount of preferably from 2 to 30 mol, more preferably from 5 to 25 mol, and even more preferably from 10 to 20 mol, based on a total of 100 mol of the raw material monomers for the styrenic resin component, not including a polymerization initiator.

Specifically, it is preferable that a hybrid resin obtained by using a dually reactive monomer is produced by the following method. It is preferable that the dually reactive monomer is used in the addition polymerization reaction together with the raw material monomers for the styrenic resin component, from the viewpoint of improvement in low-temperature fixing ability, improvement in storage stability of the toner, and suppression of unevenness in optical density of the toner.

(i) Method including the steps of (A) carrying out a polycondensation reaction of raw material monomers for a polycondensation resin component; and thereafter (B) carrying out an addition polymerization reaction of raw materials monomers for a styrenic resin component and a dually reactive monomer In this method, the step (A) is carried out under reaction temperature conditions appropriate for a polycondensation reaction, a reaction temperature is then lowered, and the step (B) is carried out under temperature conditions appropriate for an addition polymerization reaction. It is preferable that the raw material monomers for the styrenic resin component and the dually reactive monomer are added to a reaction system at a temperature appropriate for an addition polymerization reaction. The dually reactive monomer also reacts with the polycondensation resin component as well as in the addition polymerization reaction.

After the step (B), a reaction temperature is raised again, raw material monomers for a polycondensation resin component such as a trivalent or higher polyvalent monomer serving as a crosslinking agent is optionally added to the polymerization system, whereby the polycondensation reaction of the step (A) and the reaction with the dually reactive monomer can be further progressed.

(ii) Method including the steps of (B) carrying out an addition polymerization reaction of raw materials monomers for a styrenic resin component and a dually reactive monomer, and thereafter (A) carrying out a polycondensation reaction of raw material monomers for a polycondensation resin component In this method, the step (B) is carried out under reaction temperature conditions appropriate for an addition polymerization reaction, a reaction temperature is then raised, and the step (A) a polycondensation reaction is carried out under reaction temperature conditions appropriate for the polycondensation reaction. The dually reactive monomer is also involved in a polycondensation reaction as well as the addition polymerization reaction.

The raw materials for the polycondensation resin component may be present in a reaction system during the addition polymerization reaction, or the raw materials for the polymerization resin component may be added to a reaction system under temperatures conditions appropriate for the polycondensation reaction. In the former case, the progress of the polycondensation reaction can be adjusted by adding an esterification catalyst at a temperature appropriate for the polycondensation reaction.

(iii) Method including the steps of concurrently carrying out the step (A) a polycondensation reaction of raw material monomers for a polycondensation resin component; and the step (B) an addition polymerization reaction of raw materials monomers for a styrenic resin component and a dually reactive monomer In this method, it is preferable that the steps (A) and (B) are carried out under reaction temperature conditions appropriate for an addition polymerization reaction, a reaction temperature is raised, raw material monomers for the polycondensation resin component of a trivalent or higher polyvalent monomer are optionally added to a polymerization system, and the polycondensation reaction of the step (A) is further carried out. During the process, the polycondensation reaction alone can also be progressed by adding a radical polymerization inhibitor under temperature conditions appropriate for the polycondensation reaction. The dually reactive monomer is also involved in a polycondensation reaction as well as the addition polymerization reaction.

In the above method (i), a polycondensation resin that is previously polymerized may be used in place of the step (A) of carrying out a polycondensation reaction. In the above method (iii), when the steps (A) and (B) are concurrently carried out, a mixture containing raw material monomers for the styrenic resin component can be added dropwise to a mixture containing raw material monomers for the polycondensation resin component to react.

It is preferable that the above methods (i) to (iii) are carried out in the same vessel.

In the composite resin, a weight ratio of the polycondensation resin component to the styrenic resin component [polycondensation resin component/styrenic resin component] (in the present invention, the weight ratio is defined as a weight ratio of the raw material monomers for the polycondensation resin component to the raw material monomers for the styrenic resin component), more specifically a total amount of the raw material monomers for the polycondensation resin component/a total amount of the raw material monomers for the styrenic resin component, is preferably from 50/50 to 95/5, more preferably from 60/40 to 95/5, even more preferably from 70/30 to 95/5, and even more preferably from 70/30 to 90/10, from the viewpoint of improvements in storage stability and low-temperature fixing ability of the toner, from the viewpoint of suppression of unevenness in optical density of the toner, and from the viewpoint of increase in productivity of the toner, by having the polycondensation resin as a continuous phase and the styrenic resin as a dispersed phase. Here, in the above calculation, the amount of the dually reactive monomer is included in the raw material monomers for the polycondensation resin component. In addition, the amount of the polymerization initiator is not included in the amount of the raw material monomers for a styrenic resin component.

In order to obtain a composite resin that has a large molecular weight, reaction conditions, such as adjustment of a molar ratio of the carboxylic acid component to the alcohol component as mentioned above, elevation of a reaction temperature, increase in the amount of a catalyst, and a dehydration reaction being carried out for a long period of time under a reduced pressure, may be selected. Here, a crystalline resin having a large molecular weight can also be produced by stirring a reaction raw material mixture with a high-output motor, and when a crystalline resin is produced without specifically selecting production facilities, a method including the step of reacting raw material monomers in the presence of a non-reactive low-viscosity resin and a solvent is also an effective means.

The composite resin has a softening point of preferably 80° C. or higher, more preferably 90° C. or higher, even more preferably 100° C. or higher, and even more preferably 110° C. or higher, from the viewpoint of improvement in storage stability of the toner. The composite resin has a softening point of preferably 160° C. or lower, more preferably 150° C. or lower, even more preferably 140° C. or lower, and even more preferably 130° C. or lower, from the viewpoint of improvement in low-temperature fixing ability of the toner. Taken together these viewpoints, the composite resin has a softening point of preferably from 80° to 160° C., more preferably from 90° to 150° C., even more preferably from 100° to 150° C., even more preferably from 100° to 140° C., even more preferably from 110° to 140° C., and even more preferably from 110° to 130° C.

In addition, the composite resin has a melting point, i.e. a temperature of the maximum endothermic peak, of preferably 80° C. or higher, more preferably 100° C. or higher, even more preferably 110° C. or higher, and even more preferably 120° C. or higher, from the viewpoint of improvement in storage stability of the toner. In addition, the composite resin has a melting point of preferably 150° C. or lower, more preferably 140° C. or lower, even more preferably 135° C. or lower, and even more preferably 130° C. or lower, from the viewpoint of improvement in low-temperature fixing ability of the toner. Taken together these viewpoints, the composite resin has a melting point of preferably from 80° to 150° C., more preferably from 100° to 140° C., even more preferably from 110° to 135° C., and even more preferably from 120° to 130° C.

The softening point and the melting point of the composite resin can be adjusted by controlling a raw material monomer composition, a polymerization initiator, a molecular weight, an amount of a catalyst, or the like, or selecting reaction conditions.

In addition, the composite resin has a Tg of preferably −10° C. or higher, more preferably −5° C. or higher, and even more preferably 0° C. or higher, from the viewpoint of improvement in storage stability of the toner. Also, the composite resin has a Tg of preferably 50° C. or lower, more preferably 40° C. or lower, and even more preferably 30° C. or lower, from the viewpoint of improvement in low-temperature fixing ability of the toner. Taken together these viewpoints, the composite resin has a Tg of preferably from −10° to 50° C., more preferably from −5° to 40° C., and even more preferably from 0° to 30° C.

In the present invention, the crystalline resin may contain a crystalline polyester or the like. The composite resin mentioned above is contained in an amount of preferably 80% by weight or more, more preferably 90% by weight or more, even more preferably 95% by weight or more, and even more preferably substantially 100% by weight, of the crystalline resin, from the viewpoint of improvement in storage stability of the toner, and from the viewpoint of suppression of unevenness in optical density of the toner.

The composite resin is contained in an amount of preferably 5% by weight or more, more preferably 7% by weight or more, even more preferably 8% by weight or more, and even more preferably 10% by weight or more, of the resin binder, from the viewpoint of improvement in low-temperature fixing ability of the toner, and from the viewpoint of suppression of unevenness in optical density of the toner. Also, the composite resin is contained in an amount of preferably 40% by weight or less, more preferably 35% by weight or less, even more preferably 30% by weight or less, and even more preferably 25% by weight or less, of the resin binder, from the viewpoint of improvement in storage stability of the toner, and from the viewpoint of suppression of unevenness in optical density of the toner. Taken together these viewpoints, the composite resin is contained in an amount of preferably from 5 to 40% by weight, more preferably from 7 to 35% by weight, even more preferably from 7 to 30% by weight, even more preferably from 8 to 30% by weight, even more preferably from 8 to 25% by weight, and even more preferably from 10 to 25% by weight, of the resin binder.

The amorphous resin in the present invention contains a polyester obtained from an alcohol component containing an aliphatic diol in an amount of 60% by mol or more and a carboxylic acid component (amorphous polyester), from the viewpoint of enhancement of crystallization of the crystalline resin, whereby resulting in improvement in storage stability of the toner, from the viewpoint of suppression of unevenness in optical density of the toner, and from the viewpoint of improvement in productivity of the toner.

In the amorphous polyester used in the present invention, the aliphatic diol is contained in an amount of 60% by mol or more, preferably 80% by mol or more, more preferably 90% by mol or more, and even more preferably substantially 100% by mol, of the alcohol component, from the viewpoint of enhancement of crystallization of the crystalline resin, whereby resulting in improvement in storage stability of the toner, from the viewpoint of suppression of unevenness in optical density of the toner, and from the viewpoint of improvement in productivity of the toner.

It is desired that the above-mentioned aliphatic diol contains an aliphatic diol having preferably 2 to 10 carbon atoms, more preferably 3 to 8 carbon atoms, even more preferably 3 to 6 carbon atoms, and even more preferably 3 to 4 carbon atoms, from the viewpoint of enhancement of crystallization of the crystalline resin, whereby resulting in improvement in storage stability of the toner, from the viewpoint of suppression of unevenness in optical density of the toner, and from the viewpoint of improvement in productivity of the toner.

The aliphatic diol having 2 to 10 carbon atoms includes ethylene glycol, 1,2-propanediol, 1,3-propanediol, 2,3-butanediol, 1,4-butanediol, 1,5-pentanediol, 1,6-hexanediol, 1,7-heptanediol, 1,8-octanediol, 1,9-nonanediol, neopentyl glycol, 1,4-butenediol, and the like. Especially, from the viewpoint of enhancement of crystallinity of the crystalline resin, 1,2-propanediol, 2,3-butanediol, and 1,3-propanediol are preferred.

The alcohol component may contain a polyhydric alcohol component other than the aliphatic diol having 2 to 10 carbon atoms, which can be exemplified by the same polyhydric alcohols as those used in the crystalline resin mentioned above.

The carboxylic acid component preferably contains an aromatic dicarboxylic acid compound, and more preferably terephthalic acid, from the viewpoint of improvement in storage stability of the toner, and from the viewpoint of suppression of unevenness in optical density of the toner. The aromatic dicarboxylic compound is contained in an amount of preferably from 30 to 100% by mol, more preferably from 50 to 100% by mol, even more preferably from 60 to 100% by mol, and even more preferably from 85 to 100% by mol, of the carboxylic acid component.

The polycarboxylic acid compound that can be used other than the aromatic dicarboxylic acid compound can be exemplified by the same polycarboxylic acid compounds as those used in the crystalline resin mentioned above.

The amorphous polyester mentioned above can be produced by, for example, polycondensing an alcohol component and a carboxylic acid component in an inert gas atmosphere at a temperature of from 180° to 250° C. or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter that can be used together with the esterification catalyst includes gallic acid, and the like. The esterification catalyst is used in an amount of preferably from 0.01 to 1 part by weight, and more preferably from 0.1 to 0.6 parts by weight, based on 100 parts by weight of a total amount of the alcohol component and the carboxylic acid component. The esterification promoter is used in an amount of preferably from 0.001 to 0.5 parts by weight, and more preferably from 0.01 to 0.1 parts by weight, based on 100 parts by weight of a total amount of the alcohol component and the carboxylic acid component.

The above-mentioned amorphous polyester has an acid value of preferably 60 mg KOH/g or less, more preferably 50 mg KOH/g or less, and even more preferably 40 mg KOH/g or less, from the viewpoint of improvement in environmental stability of triboelectric charges of the toner.

The above-mentioned amorphous polyester has a softening point of preferably 80° C. or higher, more preferably 100° C. or higher, and even more preferably 120° C. or higher, from the viewpoint of improvement in high-temperature offset resistance of the toner. Also, the amorphous polyester has a softening point of preferably 180° C. or lower, more preferably 150° C. or lower, and even more preferably 140° C. or lower, from the viewpoint of improvement in low-temperature fixing ability of the toner. Taken together these viewpoints, the amorphous polyester has a softening point of preferably from 80° to 180° C., more preferably from 100° to 150° C., and even more preferably from 120° to 140° C. When two or more kinds of amorphous polyesters are contained, it is preferable that the weighted average of the softening points is within the above-mentioned range.

Also, in the present invention, it is preferable that the amorphous resin is composed of two kinds of amorphous resins, of which softening points are different by preferably 5° C. or higher, more preferably 10° C. or higher, and even more preferably by 20° C. or higher, from the viewpoint of improvement in high-temperature offset resistance of the toner. Of the two or more kinds of amorphous resins, the resin having the lowest softening point has a softening point of preferably from 80° to 135° C., more preferably from 95° to 120° C., and even more preferably from 105° to 115° C., from the viewpoint of low-temperature fixing ability of the toner, and the resin having the highest softening point has a softening point of preferably from 120° to 170° C., more preferably from 130° to 160° C., and even more preferably from 140° to 150° C., from the viewpoint of improvement in high-temperature offset resistance of the toner. When two or more kinds of the amorphous resins are contained, two kinds are preferred, from the viewpoint of improvement in productivity of the toner.

When two kinds of the amorphous resins are used, the high-softening point resin and the low-softening point resin are in a weight ratio, i.e. high-softening point resin/low-softening point resin, of preferably from 1/9 to 9/1, and more preferably from 2/8 to 8/2.

In addition, the above-mentioned amorphous resin has a temperature of the maximum endothermic peak of preferably 50° C. or higher, more preferably 60° C. or more, and even more preferably 65° C. or more, from the viewpoint of improvement in high-temperature offset resistance of the toner. Also, the amorphous resin has a temperature of the maximum endothermic peak of preferably 90° C. or lower, more preferably 85° C. or lower, and even more preferably 80° C. or lower, from the viewpoint of improvement in low-temperature fixing ability of the toner. Taken together these viewpoints, the amorphous resin has a temperature of the maximum endothermic peak of preferably from 50° to 90° C., more preferably from 60° to 85° C., and even more preferably from 65° to 80° C.

The above-mentioned amorphous polyester has a Tg of preferably 45° C. or higher, and more preferably 55° C. or higher, from the viewpoint of improvement in storage stability of the toner. Also, the amorphous polyester has a Tg of preferably 80° C. or lower, and more preferably 75° C. or lower, from the viewpoint of improvement in low-temperature fixing ability of the toner. Taken together these viewpoints, the amorphous polyester has a Tg of preferably from 45° to 80° C., and more preferably from 55° to 75° C. Here, Tg is a physical property peculiarly owned by the amorphous phase, which is distinguished from a temperature of the maximum endothermic peak.

The amorphous resin may contain an amorphous polyester other than the amorphous polyester obtained from an alcohol component containing an aliphatic diol in an amount of 60% by mol or more, and a carboxylic acid component, or an amorphous resin such as a vinyl resin, an epoxy resin, a polycarbonate resin, or a polyurethane resin. The amorphous polyester obtained from an alcohol component containing an aliphatic diol in an amount of 60% by mol or more, and a carboxylic acid component is contained in an amount of preferably 80% by weight or more, more preferably 90% by weight or more, even more preferably 95% by weight or more, and even more preferably substantially 100% by weight, of the amorphous resin, from the viewpoint of enhancement of crystallization of the crystalline resin, whereby resulting in improvement in storage stability of the toner, from the viewpoint of suppression of unevenness in optical density of the toner, and from the viewpoint of improvement in productivity of the toner.

The crystalline resin and the amorphous resin in the resin binder are in a weight ratio, i.e. crystalline resin/amorphous resin, of preferably from 5/95 to 40/60, more preferably from 5/95 to 35/65, even more preferably from 5/95 to 30/70, even more preferably from 7/93 to 30/70, even more preferably from 8/92 to 25/75, and even more preferably from 10/90 to 25/75, from the viewpoint of improvement in low-temperature fixing ability and improvement in storage stability of the toner, from the viewpoint of suppression of unevenness in optical density of the toner, and improvement in productivity of the toner.

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The colorant is contained in an amount of preferably from 1 to 40 parts by weight, and more preferably from 2 to 10 parts by weight, based on 100 parts by weight of the resin binder. The toner of the present invention may be any of black toners and color toners.

The toner of the present invention may contain, in addition to the resin binder and the colorant, a releasing agent, a charge control agent, or the like.

The releasing agent includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, and deacidified waxes thereof, and fatty acid ester waxes; fatty acid amides, fatty acids, higher alcohols, metal salts of fatty acids, and the like. These releasing agents may be used alone or in a mixture of two or more kinds. It is preferable that the aliphatic hydrocarbon wax and the ester wax are used together, and it is more preferable that a paraffin wax and a carnauba wax are used together. The aliphatic hydrocarbon wax and the ester wax are in a weight ratio, i.e. aliphatic hydrocarbon wax/ester wax, of preferably from 70/30 to 30/70, and more preferably from 60/40 to 40/60.

The releasing agent has a melting point of preferably from 60° to 160° C., and more preferably from 60° to 150° C., from the viewpoint of improvements in low-temperature fixing ability and high-temperature offset resistance of the toner.

The releasing agent is contained in an amount of preferably 10 parts by weight or less, more preferably 8 parts by weight or less, and even more preferably 7 parts by weight or less, based on 100 parts by weight of the resin binder, from the viewpoint of preventing filming of the toner on a photoconductor. Also, the releasing agent is contained in an amount of preferably 0.5 parts by weight or more, more preferably 1.0 part by weight or more, and even more preferably 1.5 parts by weight or more, based on 100 parts by weight of the resin binder, from the viewpoint of improvement in high-temperature offset resistance of the toner. Therefore, taken together these viewpoints, the releasing agent is contained in an amount of preferably from 0.5 to 10 parts by weight, more preferably from 1.0 to 8 parts by weight, and even more preferably from 1.5 to 7 parts by weight, based on 100 parts by weight of the resin binder. In addition, the releasing agent is contained in an amount of preferably 3 parts by weight or more, more preferably 3.5 parts by weight or more, and even more preferably 4 parts by weight or more, based on 100 parts by weight of the resin binder, from the viewpoint of effecting oil-less fusing of the toner. Therefore, taken together these viewpoints, the releasing agent is contained in an amount of preferably from 3 to 10 parts by weight, more preferably from 3.5 to 8 parts by weight, and even more preferably from 4 to 7 parts by weight, based on 100 parts by weight of the resin binder.

The charge control agent is not particularly limited. The negatively chargeable charge control agent includes metal-containing azo dyes, for example, "BONTRON S-28" (commercially available from Orient Chemical Co., Ltd.), "T-77" (commercially available from Hodogaya Chemical Co., Ltd.), "BONTRON S-34" (commercially available from Orient Chemical Co., Ltd.), "AIZEN SPILON BLACK TRH" (commercially available from Hodogaya Chemical Co., Ltd.), and the like; copper phthalocyanine dyes; metal complexes of alkyl derivatives of salicylic acid, for example, "BONTRON E-81," "BONTRON E-84," "BONTRON E-304" (hereinabove commercially available from Orient Chemical Co., Ltd.), and the like; nitroimidazole derivatives; boron complexes of benzilic acid, for example, "LR-147" (commercially available from Japan Carlit, Ltd.); nonmetallic charge control agents, for example, "BONTRON F-21," "BONTRON E-89"(hereinabove commercially available from Orient Chemical Co., Ltd.), "T-8" (commercially available from Hodogaya Chemical Co., Ltd.), "FCA-2521NJ," "FCA-2508N"(hereinabove commercially available from FUJIKURA KASEI CO., LTD.), and the like.

The positively chargeable charge control agent includes positively chargeable charge control agents that are non-polymeric compounds, including Nigrosine dyes, for example, "BONTRON N-01," "BONTRON N-04," "BONTRON N-07" (hereinabove commercially available from Orient Chemical Co., Ltd.), "CHUO CCA-3"(commercially available from CHUO GOUSEI KAGAKU CO., LTD.), and the like; triphenylmethane-based dyes containing a tertiary amine as a side chain; quaternary ammonium salt compounds, for example, "BONTRON P-51" (commercially available from Orient Chemical Co., Ltd.), "TP-415" (commercially available from Hodogaya Chemical Co., Ltd.), cetyltrimethylammonium bromide, "COPY CHARGE PX VP435" (commercially available from Clariant Japan, Ltd.); imidazole derivatives, for example, "PLZ-2001," "PLZ-8001" (hereinabove commercially available from Shikoku Kasei Chemical Co., Ltd.), and the like; and positively chargeable control agents that are polymeric compounds, including polyamine resins, for example "AFP-B" (commercially available from Orient Chemical Co., Ltd.) and the like; styrene-acrylic resins, for example, "FCA-201-PS" (commercially available from FUJIKURA KASEI CO., LTD.); and the like.

The negatively chargeable charge control agent is contained in an amount of preferably 0.1 parts by weight or more, and more preferably 0.2 parts by weight or more, based on 100 parts by weight of the resin binder, from the viewpoint of adjustment of triboelectric charges of the toner to an appropriate level to provide suppression in background fogging. In addition, the negatively chargeable charge control agent is contained in an amount of preferably 5 parts by weight or less, and more preferably 3 parts by weight or less, based on 100 parts by weight of the resin binder, from the viewpoint of adjustment of triboelectric charges of the toner to an appropriate level to provide improvement in developability. In other words, taken together these viewpoints, the negatively chargeable charge control agent is contained in an amount of preferably from 0.1 to 5 parts by weight, and more preferably from 0.2 to 3 parts by weight, based on 100 parts by weight of the resin binder.

The positively chargeable charge control agent is contained in an amount of preferably 0.3 parts by weight or more, more preferably 1 part by weight or more, and even more preferably 2 parts by weight or more, based on 100 parts by weight of the resin binder, from the viewpoint of adjustment of triboelectric charges of the toner to an appropriate level to provide suppression in background fogging. In addition, the positively chargeable charge control agent is contained in an amount of preferably 20 parts by weight or less, more preferably 15 parts by weight or less, and even more preferably 10 parts by weight or less, based on 100 parts by weight of the resin binder, from the viewpoint of adjustment of triboelectric charges of the toner to an appropriate level to provide improvement in developability. In other words, taken together these viewpoints, the positively chargeable charge control agent is contained in an amount of preferably from 0.3 to 20 parts by weight, more preferably from 1 to 15 parts by weight, and even more preferably from 2 to 10 parts by weight, based on 100 parts by weight of the resin binder.

The positively chargeable charge control agent that is a non-polymeric compound is contained in an amount of preferably from 0.3 to 10 parts by weight, more preferably from 0.5 to 5 parts by weight, and even more preferably from 1 to 3 parts by weight, based on 100 parts by weight of the resin binder, from the viewpoint of adjustment of triboelectric charges of the toner to an appropriate level to provide suppression in background fogging, and from the viewpoint of improvement in developability.

The positively chargeable charge control resin is contained in an amount of preferably from 1 to 20 parts by weight, more preferably from 2 to 10 parts by weight, and even more preferably from 3 to 8 parts by weight, based on 100 parts by weight of the resin binder, from the viewpoint of adjustment of triboelectric charges of the toner to an appropriate level to provide suppression in background fogging, and from the viewpoint of improvement in developability.

The positively chargeable charge control agent that is a non-polymeric compound and the positively chargeable charge control resin may be used together, and in that case, the positively chargeable charge control agent that is a non-polymeric compound is contained in an amount of preferably from 0.3 to 10 parts by weight, more preferably from 0.5 to 5 parts by weight, and even more preferably from 1 to 3 parts by weight, based on 100 parts by weight of the resin binder, from the same viewpoint. In addition, the positively chargeable charge control resin is contained in an amount of preferably from 1 to 20 parts by weight, more preferably from 2 to 10 parts by weight, and even more preferably from 3 to 8 parts by weight, based on 100 parts by weight of the resin binder, from the same viewpoint. The positively chargeable charge control agent that is a non-polymeric compound and the positively chargeable charge control resin are contained in a total amount of preferably from 1 to 20 parts by weight, more preferably from 2 to 15 parts by weight, and even more preferably from 3 to 10 parts by weight, based on 100 parts by weight of the resin binder, from the same viewpoint.

The toner in the present invention may further properly contain an additive such as a magnetic particulate, a fluidity improver, an electric conductivity modifier, an extender pigment, a reinforcing filler such as a fibrous material, an antioxidant, an anti-aging agent, or a cleanability improver.

The toner in the present invention is obtained by a method including the step (1) of melt-kneading at least a resin binder containing a crystalline resin and an amorphous resin and a colorant. Further, the toner of the present invention is obtained by a method including the step (2) of heat-treating the kneaded product obtained in the step (1). By including the step (2), the toner satisfies both low-temperature fixing ability and storage stability.

The step 1 of melt-kneading raw materials for a toner containing at least a resin binder and a colorant, in other words, a crystalline resin, an amorphous resin, a colorant and the like can be carried out with a known kneader, such as a closed kneader, a single-screw or twin-screw extruder, or a continuous open-roller type kneader. Since the additives can be efficiently highly dispersed in the resin binder without repeats of kneading or without a dispersion aid, a continuous open-roller type kneader provided with feeding ports and a discharging port for a kneaded product along the shaft direction of the roller is preferably used.

It is preferable that the raw materials for a toner are previously homogeneously mixed with a HENSCHEL-MIXER, a SUPER-MIXER or the like, and thereafter fed to an open-roller type kneader, and the raw materials may be fed from one feeding port, or dividedly fed to the kneader from plural feeding ports. It is preferable that the raw materials for the toner are fed to the kneader from one feeding port, from the viewpoint of easiness of operation and simplification of an apparatus.

The continuous open-roller type kneader refers to a kneader of which kneading member is an open type, not being tightly closed, and the kneading heat generated during the kneading can be easily dissipated. In addition, it is desired that the continuous open-roller type kneader is a kneader provided with at least two rollers. The continuous open-roller type kneader preferably used in the present invention is a kneader provided with two rollers having different peripheral speeds, in other words, two rollers of a high-rotation roller having a high peripheral speed and a low-rotation roller having a low peripheral speed. In the present invention, it is desired that the high-rotation roller is a heat roller, and the low-rotation roller is a cooling roller, from the viewpoint of improvement in dispersibility of the raw materials for a toner, such as a colorant and a releasing agent, in the resin binder.

The temperature of the roller can be adjusted by, for example, a temperature of a heating medium passing through the inner portion of the roller, and each roller may be divided in two or more portions in the inner portion of the roller, each being communicated with heating media of different temperatures.

The temperature at the end part of the raw material supplying side of the high-rotation roller is preferably from 100° to 160° C., and the temperature at the end part of the raw material supplying side of the low-rotation roller is preferably from 35° to 100° C.

In the high-rotation roller, the difference between a setting temperature at the end part of the raw material supplying side and a setting temperature at the end part of the kneaded product discharging side is preferably from 20° to 60° C., more preferably from 20° to 50° C., and even more preferably from 30° to 50° C., from the viewpoint of prevention in detachment of the kneaded product from the roller. In the low-rotation roller, the difference between a setting temperature at the end part of the raw material supplying side and a setting temperature at the end part of the kneaded product discharging side is preferably from 0° to 50° C., more preferably from 0° to 40° C., and even more preferably from 0° to 20° C., from the viewpoint of improvement in dispersibility of the raw materials for a toner, such as a colorant and a releasing agent, in the resin binder.

The peripheral speed of the high-rotation roller is preferably from 2 to 100 m/min, and more preferably from 4 to 50 m/min. The peripheral speed of the low-rotation roller is preferably from 1 to 90 m/min, more preferably from 2 to 60 m/min, and even more preferably from 2 to 50 m/min. In addition, the ratio between the peripheral speeds of the two rollers, i.e., low-rotation roller/high-rotation roller, is preferably from 1/10 to 9/10, and more preferably from 3/10 to 8/10.

Structures, size, materials and the like of the roller are not particularly limited. Also, the surface of the roller may be any of smooth, wavy, rugged, or other surfaces. In order to increase kneading share, it is preferable that plural spiral ditches are engraved on the surface of each roller.

The step 2 is a step of heat-treating the kneaded product obtained in the step 1. The heat-treating step may be carried out in any steps, subsequent to the kneading step. Although the method of the present invention can be applied to the production of a pulverized toner prepared by pulverizing a kneaded product to provide a toner, or to the production of a polymerization toner obtained by dispersing a kneaded product as particles in a solvent, it is preferable that the method is used in the production of a pulverized toner that does not include a step of carrying thermal treatment other than the heat-treating step. In the present invention, in the production of a pulverized toner, a kneaded product obtained by the melt-kneading step is pulverized, and the resulting pulverized product may then be subjected to a heat-treating step, so long as a phase separation structure of a crystalline resin and an amorphous resin in the kneaded product is stabilized by the thermal treatment so that re-crystallization of the crystalline resin is enhanced. It is preferable that the heat-treating step is carried out subsequent to the kneading step but prior to the pulverizing step, from the viewpoint of improvement in storage stability of the toner and from the viewpoint of improvement in productivity.

In a general method for producing a toner for a pulverized toner, the resulting kneaded product is cooled to a point of attaining a pulverizable hardness, and then subjected to a pulverizing step and a classifying step; however, in the present invention, it is preferable that a pulverizing step is carried out subsequent to the kneading step, and after subjecting the resulting kneaded product to a heat-treating step, as mentioned above.

In the present invention, the temperature for the heat-treating step is preferably equal or higher than a glass transition temperature of the kneaded product, more preferably a temperature calculated from a glass transition temperature plus 10° C. or more, and even more preferably a temperature calculated from a glass transition temperature plus 15° C. or more, from the viewpoint of maintaining dispersibility of toner additives, from the viewpoint of rearrangement of resin binder molecules, whereby resulting in improvement in storage stability of the toner, and from the viewpoint of shortening the heat-treatment time, whereby resulting in improvement in productivity of the toner. In addition, the temperature for the heat-treating step is preferably a temperature equal to or lower than a melting point of the crystalline resin, more preferably a temperature calculated from a melting point minus 10° C. or more, and even more preferably a temperature calculated from a melting point minus 15° C. or more, from the viewpoint of prevention of the lowering in storage stability of the toner due to disorder of arrangements accompanying dissolution of the crystals. Specifically, it is desired that the heat-treatment step is carried out at a temperature of from 50° to 80° C., and more preferably from 60° to 80° C.

In addition, the heat treatment time is preferably 1 hour or longer, more preferably 3 hours or longer, and even more preferably 6 hours or longer, from the viewpoint of enhancement of crystallinity of the crystalline resin, whereby resulting in improvement in storage stability of the toner. Also, the heat treatment time is preferably 12 hours or shorter, and more preferably 8 hours or shorter, from the viewpoint of improvement in productivity of the toner. In other words, taken together these viewpoints, the heat treatment time is preferably from 1 to 12 hours, more preferably from 3 to 8 hours, and even more preferably from 6 to 8 hours. Here, this heat treatment time is a cumulative time at which the temperature is within the temperature range defined above (a temperature equal to or higher than the glass transition temperature of the kneaded product and equal to lower than the melting point of the crystalline resin). In addition, it is preferable that the temperature does not exceed the upper limit of the temperature range defined above from the beginning to the end of the heat-treating step, from the viewpoint of maintaining dispersibility of the toner additives.

In the present invention, the heat-treating step is carried out at the temperature defined above for the time as defined above, whereby it is deduced that the rearrangement of the resin in the kneaded product is accelerated, so that the glass transition temperature of the kneaded product once lowered is recovered, thereby providing a more remarkable improvement in storage stability of the toner. Further, a plastic part, in other words a part having a low-glass transition temperature, is likely to absorb shock during the pulverization, thereby giving causations for lowering a pulverization efficiency. In the present invention, since the plasticization is suppressed by carrying out the heat-treating step before the pulverizing step, the pulverizability can be also improved.

In the heat-treating step, an oven or the like can be used. For example, in a case where an oven is used, a heat-treating step can be carried out by maintaining a kneaded product in the oven at a given temperature.

Embodiments for carrying out the heat-treating step are not particularly limited, and include, for example:

Embodiment 1: an embodiment including the steps of, subsequent to a kneading step, pulverizing a kneaded product in a pulverizing step, and keeping a pulverized kneaded product under the heat-treatment conditions mentioned above;

Embodiment 2: an embodiment including the steps of, subsequent to a kneading step, keeping a kneaded product under the heat-treatment conditions mentioned above in the process of cooling the resulting kneaded product, further cooling the kneaded product to a point of attaining a pulverizable hardness, and subjecting the cooled product to a subsequent step such as a pulverizing step;

Embodiment 3: an embodiment including the steps of, subsequent to a kneading step, once cooling the resulting kneaded product to a pulverizable hardness, subjecting the cooled kneaded product to the above-mentioned heat-treating step, cooling the kneaded product again, and subjecting the cooled product to a subsequent step such as a pulverizing step;

and the like. In the present invention, the heat-treating step may be carried out in any of the Embodiments, and Embodiment 3 is preferred from the viewpoint of maintaining dispersibility of additives in a toner.

In the present invention, in the pulverizing step, pulverization may be carried out while mixing a production intermediate with fine inorganic particles. For example, pulverization may be carried out while mixing silica and a production intermediate.

The pulverizing step may be carried out in divided multistages. For example, the heat-treated product after the heat-treating step may be roughly pulverized to a size of from 1 to 5 mm or so, and the roughly pulverized product may be further finely pulverized to a desired particle size.

The pulverizer used in the pulverization step is not particularly limited. For example, the pulverizer used preferably in the rough pulverization includes an atomizer, Rotoplex, and the like, and the pulverizer used preferably in the fine pulverization includes a jet mill, an impact type mill, a rotary mechanical mill, and the like.

The classifier used in the classifying step includes an air classifier, a rotor type classifier, a sieve classifier, and the like. The pulverized product which is insufficiently pulverized and removed during the classifying step may be subjected to the pulverization step again.

The toner obtained by the present invention has a volume-median particle size ($D_{50}$) of preferably from 3.0 to 12 μm, more preferably from 3.5 to 10 μm, and even more preferably from 4 to 9 μm, from the viewpoint of improving the image quality of the toner. The term "volume-median particle size ($D_{50}$)" as used herein means a particle size of which cumulative volume frequency calculated on a volume percentage is 50% counted from the smaller particle sizes.

The toner in the present invention may be obtained by a method including the step of further mixing a toner after a pulverizing step and a classifying step, with an external additive such as fine inorganic particles made of silica or the like, or fine resin particles made of polytetrafluoroethylene or the like.

It is preferable that the external additive is a silica. It is more preferable that two or more kinds of silicas having different average particle sizes are used together, and it is even more preferable that a silica having an average particle size of less than 20 nm and a silica having an average particle size of 20 nm or more are used together in a weight ratio of from 90/10 to 10/90.

In the mixing of a pulverized product or the toner particles obtained after a classifying step with an external additive, an agitator having an agitating member such as rotary impellers is preferably used, and a more preferred agitator includes a HENSCHEL-MIXER.

The toner in the present invention can be either directly used as a toner for monocomponent development, or used as a two-component developer containing a toner mixed with a carrier in an apparatus for forming fixed images of a monocomponent development or a two-component development.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Temperature of Maximum Endothermic Peak and Melting Point of Resin]

Measurements were taken using a differential scanning calorimeter ("Q-100," commercially available from TA Instruments, Japan), by cooling a 0.01 to 0.02 g sample weighed out in an aluminum pan from room temperature to 0° C. at a cooling rate of 10° C./min, allowing the cooled sample to stand for 1 minute, and thereafter heating the sample at a rate of 50° C./min. Among the endothermic peaks observed, the temperature of an endothermic peak on the highest temperature side is defined as a temperature of maximum endothermic peak. When a difference between the temperature of maximum endothermic peak and the softening point is within 20° C., the temperature of maximum endothermic peak is defined as a melting point.

[Glass Transition Temperatures of Amorphous Resin and Kneaded Product]

Measurements were taken using a differential scanning calorimeter ("Q-100," commercially available from TA Instruments, Japan), by heating a 0.01 to 0.02 g sample weighed out in an aluminum pan to 200° C. at a rate of 10° C./min. A temperature of an intersection of the extension of the baseline of equal to or lower than the temperature of maximum endothermic peak and the tangential line showing the maximum inclination between the kick-off of the peak and the top of the peak in the above measurement is defined as a glass transition temperature.

[Glass Transition Temperatures of Crystalline Resin (Composite Resin)]

Measurements were taken using a differential scanning calorimeter ("Q-100," commercially available from TA Instruments, Japan) in a modulated mode, by heating a 0.01 to 0.02 g sample weighed out in an aluminum pan to 200° C., cooling the sample from that temperature to −80° C. at a cooling rate of 100° C./min, and raising the temperature of the sample at a rate of 1° C./min. A temperature of an intersection of the extension of the baseline of equal to or lower than the temperature of maximum endothermic peak and the tangential line showing the maximum inclination between the kick-off of the peak and the top of the peak in reverse heat flow line of the above measurement is defined as a glass transition temperature.

[Acid Value of Resin]

The acid value is determined by a method according to JIS K0070 except that only the determination solvent is changed from a mixed solvent of ethanol and ether as defined in JIS K0070 to a mixed solvent of acetone and toluene (volume ratio of acetone:toluene=1:1).

[Melting Point of Releasing Agent]

A temperature of maximum endothermic peak of the heat of fusion obtained by raising the temperature of a sample to 200° C., cooling the sample from this temperature to 0° C. at a cooling rate of 10° C./min, and thereafter raising the temperature of the sample at a heating rate of 10° C./min, using a differential scanning calorimeter ("DSC 210," commercially available from Seiko Instruments, Inc.) is referred to as a melting point.

[Volume-Median Particle Size ($D_{50}$) of Toner]

Measuring Apparatus Coulter Multisizer II (commercially available from Beckman Coulter, Inc.)

Aperture Diameter: 100 μm

Analyzing Software: Coulter Multisizer AccuComp Ver. 1.19 (commercially available from Beckman Coulter, Inc.)

Electrolytic solution: "Isotone II" (commercially available from Beckman Coulter, Inc.)

Dispersion: "EMULGEN 109P" (commercially available from Kao Corporation, polyoxyethylene lauryl ether, HLB: 13.6) is dissolved in the above electrolytic solution so as to have a concentration of 5% by weight to provide a dispersion.

Dispersion Conditions Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

[Average Particle Size of External Additive]

Particle sizes were determined for 500 particles from a photograph taken with a scanning electron microscope (SEM), an average of length and breadth of the particles of which is taken, and the average is referred to as an average primary particle size.

[Production Example 1 of Crystalline Resins]

A 10-liter four-neck flask equipped with a nitrogen inlet tube, a dehydration tube, a stirrer, and a thermocouple was charged with raw material monomers for a polycondensation resin component other than a dually reactive monomer acrylic acid as listed in Table 1, and the contents were heated to 160° C. to dissolve. A solution prepared by previously mixing styrene, dicumyl peroxide, and acrylic acid was added dropwise thereto from a dropping funnel over a period of 1 hour. The mixture was continued stirring for 1 hour while keeping the temperature at 170° C. to allow polymerization between styrene and acrylic acid. Subsequently, 40 g of tin(II) 2-ethylhexanoate and 3 g of gallic acid were added thereto, the temperature of the contents was raised to 210° C., and the components were reacted for 8 hours. Further, the components were reacted at 8.3 kPa for 1 hour, to provide a crystalline composite resin (Resin A). The physical properties of the resin for Resin A obtained are shown in Table 1.

TABLE 1

| Crystalline Resin | Resin A | Resin C | Resin D | Resin E |
|---|---|---|---|---|
| Raw Material Monomers | | | | |
| Raw Material Monomers for Polycondensation Resin Component (P)[1)] | | | | |
| 1,6-Hexanediol | 100 (3540 g) | 100 (4130 g) | 100 (2950 g) | 70 (2643 g) |
| 1,4-Butanediol | — | — | — | 30 (864 g) |
| Terephthalic Acid | 78 (3884 g) | 88 (5113 g) | 60 (2490 g) | 78 (4143 g) |
| Acrylic Acid (Dually Reactive Monomer) | 7 (151 g) | 2 (50 g) | 15 (270 g) | 7 (161 g) |
| Raw Material Monomers for Styrenic Resin Component (S)[2)] | | | | |
| Styrene | 100 (1782 g) | 100 (492 g) | 100 (3486 g) | 100 (1831 g) |
| Dicumyl Peroxide (Polymerization Initiator) | 6 (107 g) | 6 (30 g) | 6 (209 g) | 6 (110 g) |
| Total Amount of P/Total Amount of S (Weight Ratio)[3)] | 81/19 | 95/5 | 62/38 | 81/19 |
| Number of Moles of Dually Reactive Monomer per 100 mol of Total Number of Moles of S[4)] | 12 | 15 | 11 | 13 |
| Physical Properties of Resin | | | | |
| Glass Transition Temperature (° C.) of Styrenic Resin Component According to Fox Formula (Tg1) | 100 | 100 | 100 | 100 |
| Glass Transition Temperature (° C.) of Crystalline Resin (Tg2) | 16 | 4 | 25 | 15 |
| Tg1 − Tg2 | 84 | 96 | 75 | 85 |
| Softening Point (° C.) | 130 | 138 | 105 | 108 |
| Temperature of Maximum Endothermic Peak [Melting Point] (° C.) | 129 | 135 | 112 | 110 |
| Ratio of Softening Point/Temperature of Maximum Endothermic Peak | 1.01 | 1.02 | 0.94 | 0.98 |

[1)]Numerical values show amounts (number of moles supposing that a total amount of the alcohol component is 100), and the value inside the parenthesis shows weight.

[2)]Numerical values show amounts (weight ratio supposing that a total amount of the raw material monomers for a styrenic resin component is 100), and the value inside the parenthesis shows weight.

[3)]A total amount of the raw material monomers for a styrenic resin component does not include dicumyl peroxide.

[4)]A total number of moles of the raw material monomers for a styrenic resin component does not include dicumyl peroxide.

[Production Example 2 of Crystalline Resin]

A 5-liter four-neck flask equipped with a nitrogen inlet tube, a dehydration tube, a stirrer, and a thermocouple was charged with 870 g of 1,6-hexanediol, 1575 g of 1,4-butanediol, 2950 g of fumaric acid, 2 g of hydroquinone, 40 g of tin(II) 2-ethylhexanoate, and 3 g of gallic acid, the component were reacted at 160° C. in a nitrogen atmosphere over a period of 5 hours, the temperature was raised to 200° C., and the components were reacted for an additional 1 hour. Further, the components were reacted at 8.3 kPa until the softening point reached 112° C., to provide a crystalline polyester (Resin B). Resin B obtained had a softening point of 112° C., a temperature of maximum endothermic peak of 110° C., and a ratio of [softening point/temperature of maximum endothermic peak] of 1.02.

[Production Example 3 of Crystalline Resin]

The same procedures as in Production Example 1 of Crystalline Resin were carried out except that raw materials in amounts listed in Table 1 were used, to provide each of crystalline composite resins (Resins C to E). The physical properties of the resins for Resins C to E obtained are shown in Table 1.

[Production Example 1 of Amorphous Resin]

A 5-liter four-neck flask equipped with a dehydration tube equipped with a distillation tower through which hot water at 100° C. was allowed to flow, a nitrogen inlet tube, a stirrer, and a thermocouple was charged with 1368 g of 1,2-propanediol, 2151 g of terephthalic acid, 482 g of tetrapropenylsuccinic anhydride, and 4 g of dibutyltin oxide. The temperature was raised from 180° to 230° C. over a period of 8 hours, and the components were reacted. Further, the components were reacted at 8.3 kPa for additional 1 hour, 346 g of trimellitic anhydride was then added thereto, and the components were reacted at 220° C. and 40 kPa until a softening point reached 130° C., to provide an amorphous polyester (Resin a). Resin a had a glass transition temperature of 65° C., a softening point of 130° C., a temperature of maximum endothermic peak of 69° C., a ratio of [softening point/temperature of maximum endothermic peak] of 1.9, and an acid value of 32.7 mg KOH/g.

[Production Example 2 of Amorphous Resin]

A 5-liter four-neck flask equipped with a dehydration tube equipped with a distillation tower through which hot water at 100° C. was allowed to flow, a nitrogen inlet tube, a stirrer, and a thermocouple was charged with 152 g of 1,3-propanediol, 1620 g of 2,3-butanediol, 1992 g of isophthalic acid, and 4 g of dibutyltin oxide. The temperature was raised from 180° to 230° C. over a period of 8 hours, and the components were reacted. Further, the components were reacted at 8.3 kPa for additional 1 hour, 499 g of trimellitic anhydride was then added thereto, and the components were reacted at 220° C. and 40 kPa until a softening point reached 142° C., to provide an amorphous polyester (Resin b). Resin b had a glass transition temperature of 64° C., a softening point of 142° C., a temperature of maximum endothermic peak of 70° C., a ratio of [softening point/temperature of maximum endothermic peak] of 2.0, and an acid value of 11.3 mg KOH/g.

[Production Example 3 of Amorphous Resin]

A 5-liter four-neck flask equipped with a dehydration tube equipped with a distillation tower through which hot water at 100° C. was allowed to flow, a nitrogen inlet tube, a stirrer, and a thermocouple was charged with 495 g of ethylene glycol, 795 g of neopentyl glycol, 2205 g of terephthalic acid, and 4 g of dibutyltin oxide. The temperature was raised from 180° to 230° C. over a period of 8 hours, and the components were reacted. Further, the components were reacted at 8.3 kPa for additional 1 hour, 300 g of trimellitic anhydride was then added thereto, and the components were reacted at 220° C. and 40 kPa until a softening point reached 132° C., to provide an amorphous polyester (Resin c). Resin c had a glass transition temperature of 66° C., a softening point of 132° C., a temperature of maximum endothermic peak of 70° C., a ratio of [softening point/temperature of maximum endothermic peak] of 1.9, and an acid value of 28.8 mg KOH/g.

[Production Example 4 of Amorphous Resin]

A 5-liter four-neck flask equipped with a dehydration tube equipped with a distillation tower through which hot water at 100° C. was allowed to flow, a nitrogen inlet tube, a stirrer, and a thermocouple was charged with 1660 g of terephthalic acid, 1660 g of isophthalic acid, 2800 g of polyoxypropylene (2.2)-2,2-bis(4-hydroxyphenyl)propane, 744 g of ethylene glycol, and 10 g of tin octylate (tin(II) 2-ethylhexanoate). The temperature was raised from 180° to 230° C. over a period of 8 hours, and the components were subjected to an esterification reaction at 230° C. and normal pressure for 5 hours. Next, the pressure was gradually reduced over 40 minutes to a degree of vacuum of 0.133 kPa at 240° C., and the components were reacted until a softening point reached 122° C., to provide an amorphous polyester (Resin d). Resin d had a glass transition temperature of 63° C., a softening point of 122° C., a temperature of maximum endothermic peak of 68° C., a ratio of [softening point/temperature of maximum endothermic peak] of 1.8, and an acid value of 20.2 mg KOH/g.

[Production Example 5 of Amorphous Resin]

A 10-liter four-neck flask equipped with a nitrogen inlet tube, a dehydration tube, a stirrer, and a thermocouple was charged with 3486 g of polyoxypropylene(2.2)-2,2-bis(4-hydroxyphenyl)propane, 3240 g of polyoxyethylene(2.2)-2,2-bis(4-hydroxyphenyl)propane, 1881 g of terephthalic acid, 269 g of tetrapropenylsuccinic anhydride, 30 g of tin(II) 2-ethylhexanoate, and 2 g of gallic acid. The components were reacted in a nitrogen atmosphere at 230° C. until a reaction rate reached 90% at 230° C., and thereafter the components were reacted at 8.3 kPa for 1 hour. Next, 789 g of trimellitic anhydride was supplied thereinto, and the components were reacted at 220° C. until a softening point reached 122° C., to provide an amorphous polyester (Resin e). Resin e had a glass transition temperature of 64° C., a softening point of 122° C., a temperature of maximum endothermic peak of 65° C., a ratio of [softening point/temperature of maximum endothermic peak] of 1.9, and an acid value of 18.9 mg KOH/g. Here, the reaction percentage refers to a value calculated by [amount of water generated/theoretical amount of water generated]×100.

[Production Example 6 of Amorphous Resin]

A 5-liter four-neck flask equipped with a dehydration tube equipped with a distillation tower through which hot water at 100° C. was allowed to flow, a nitrogen inlet tube, a stirrer, and a thermocouple was charged with 2169 g of 1,2-propanediol, 3362 g of terephthalic acid, 30.3 g of tin(II) 2-ethylhexanoate, and 3.0 g of gallic acid. The temperature was raised from 180° to 230° C. over a period of 8 hours, and the components were reacted. Further, the reaction mixture was reacted at 8.3 kPa for 1 hour, and 528 g of trimellitic anhydride was then added thereto, and the components were reacted at 220° C. and 40 kPa until a softening point reached 148° C., to provide an amorphous polyester (Resin f). Resin f had a glass transition temperature of 70° C., a softening point of 148° C., a temperature of maximum endothermic peak of 80° C., a ratio of [softening point/temperature of maximum endothermic peak] of 1.9, and an acid value of 9.3 mg KOH/g.

[Production Example 7 of Amorphous Resin]

A 5-liter four-neck flask equipped with a dehydration tube equipped with a distillation tower through which hot water at 100° C. was allowed to flow, a nitrogen inlet tube, a stirrer, and a thermocouple was charged with 1918 g of 1,2-propanediol, 3187 g of terephthalic acid, 26.4 g of tin(II) 2-ethylhexanoate, and 2.6 g of gallic acid. The temperature was raised from 180° to 230° C. over a period of 8 hours, and the components were reacted. Further, the reaction mixture was reacted at 8.3 kPa for 1 hour, and 161 g of trimellitic anhydride was then added thereto, and the components were reacted at 220° C. and 40 kPa until a softening point reached 112° C., to provide an amorphous polyester (Resin g). Resin g had a glass transition temperature of 67° C., a softening point of 112° C., a temperature of maximum endothermic peak of 75° C., a ratio of [softening point/temperature of maximum endothermic peak] of 1.5, and an acid value of 4.9 mg KOH/g.

Examples A1 to A8 and Comparative Examples A1 to A4

An amorphous resin and a crystalline resin in given amounts listed in Table 2, 0.2 parts by weight of a negatively chargeable charge control agent "BONTRON E-304" (commercially available from Orient Chemical Co., Ltd.), 3 parts by weight of Carnauba Wax C1 (commercially available from S. Kato & CO., melting point: 88° C.), 3 parts by weight of a paraffinic wax "HNP-9" (commercially available from NIPPON SEIRO CO., LTD., melting point: 75° C.), and 4.5 parts by weight of a colorant "ECB-301" (commercially available from DAINICHISEIKA COLOR & CHEMICALS MFG. CO., LTD., phthalocyanine blue (P.B. 15:3)) were mixed with a HENSCHEL-MIXER for 1 minute, and the mixture was then melt-kneaded under the following conditions.

A continuous twin open-roller type kneader "Kneadex" (commercially available from MITSUI MINING COMPANY, LIMITED, outer diameter of roller: 14 cm, effective length of roller: 80 cm) was used. The operating conditions of the continuous twin open-roller type kneader are a peripheral speed of a high-rotation roller (front roller) of 75 r/min (32.97 m/min), a peripheral speed of a low-rotation roller (back roller) of 50 r/min (21.98 m/min), and a gap between the rollers at the end part of the feeding ports of the kneaded product of 0.1 mm. The temperatures of the heating medium and the cooling medium inside the rollers are as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 10 kg/hour, and the average residence time was about 10 minutes.

The kneaded product obtained above was pressed with a cooling roller to cool it to 20° C. or lower, and the pressed product was heat-treated in an oven at 70° C. for 12 hours.

The heat-treated product after the heat treatment was cooled to 30° C., and the cooled product was roughly pulverized to a size of 3 mm with Rotoplex (commercially available from TOA KIKAI SEISAKUSHO). Thereafter, the roughly pulverized product was pulverized with a fluidized bed-type jet mill "AFG-400" (commercially available from HOSOKAWA ALPINE A.G.), the pulverized product was classified with a rotor-type classifier "TTSP" (commercially available from HOSOKAWA ALPINE A.G.), to provide toner matrix particles having a volume-median particle size ($D_{50}$) of 8.0 μm. To 100 parts by weight of the toner matrix particles was added 1.0 part by weight of a hydrophobic silica "RY50" (commercially available from Nippon Aerosil Co., Ltd., average particle size: 40 nm), and 0.5 parts by weight of a hydrophobic silica "R972" (commercially available from Nippon Aerosil Co., Ltd., average particle size: 16 nm) with a HENSCHEL MIXER (commercially available from MITSUI MINING COMPANY, LIMITED) at 1500 r/min (16 m/sec) for one minute, to provide a negatively chargeable toner.

Example A9 and Comparative Examples A5 and A6

An amorphous resin and a crystalline resin in given amounts listed in Table 2, positively chargeable charge control agents 3 parts by weight of "FCA-201" (commercially available from FUJIKURA KASEI CO., LTD.) and 1 part by weight of "BONTRON P-51" (commercially available from Orient Chemical Co., Ltd.), 3 parts by weight of Carnauba Wax C1 (commercially available from S. Kato & CO., melting point: 88° C.), 3 parts by weight of a paraffinic wax "HNP-9" (commercially available from NIPPON SEIRO CO., LTD., melting point: 75° C.), and 7.0 parts by weight of a colorant "ECB-301" (commercially available from DAINICHISEIKA COLOR & CHEMICALS MFG. CO., LTD., phthalocyanine blue (P.B. 15:3)) were mixed with a HENSCHEL-MIXER for 1 minute, and the mixture was then melt-kneaded under the following conditions.

A continuous twin open-roller type kneader "Kneadex" (commercially available from MITSUI MINING COMPANY, LIMITED, outer diameter of roller: 14 cm, effective length of roller: 80 cm) was used. The operating conditions of the continuous twin open-roller type kneader are a peripheral speed of a high-rotation roller (front roller) of 75 r/min (32.97 m/min), a peripheral speed of a low-rotation roller (back roller) of 50 r/min (21.98 m/min), and a gap between the rollers at the end part of the feeding ports of the kneaded product of 0.1 mm. The temperatures of the heating medium and the cooling medium inside the rollers are as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 10 kg/hour, and the average residence time was about 10 minutes.

The kneaded product obtained above was pressed with a cooling roller to cool it to 20° C. or lower, and the pressed product was heat-treated in an oven at 70° C. for 12 hours.

The heat-treated product after the heat treatment was cooled to 30° C., and the cooled product was roughly pulverized to a size of 3 mm with Rotoplex (commercially available from TOA KIKAI SEISAKUSHO). Thereafter, 1.0 part by weight of a positively chargeable silica "REA90" (commercially available from Nippon Aerosil Co., Ltd., average particle size: 20 nm) was mixed with 100 parts by weight of the roughly pulverized product with a HENSCHEL-MIXER (commercially available from MITSUI MINING COMPANY, LIMITED) at 1200 r/min for one minute, and pulverized with a fluidized bed-type jet mill "AFG-400" (commercially available from HOSOKAWA ALPINE A.G.), the pulverized product was classified with a rotor-type classifier "TTSP" (commercially available from HOSOKAWA ALPINE A.G.), to provide toner matrix particles having a volume-median particle size ($D_{50}$) of 8.0 μm. To 100 parts by weight of the toner matrix particles was added 1.0 part by weight of a hydrophobic silica "NA50H" (commercially available from Nippon Aerosil Co., Ltd., average particle size: 40 nm), and 0.5 parts by weight of a hydrophobic silica "RA200HS" (commercially available from Nippon Aerosil Co., Ltd., average particle size: 12 nm) with a HENSCHEL-MIXER (commercially available from MITSUI MINING COMPANY, LIMITED) at 1500 r/min (16 m/sec) for one minute, to provide a positively chargeable toner.

Test Example 1 [Unevenness in Optical Density]

Each of the toners of Examples A1 to A8 and Comparative Examples A1 to A4 was loaded in a nonmagnetic monocomponent development device "OKI MICROLINE 5400" (commercially available from Oki Data Corporation) equipped with an organic photoconductor (OPC), and allowed to stand under the environmental conditions of 25° C. and 50% RH for 12 hours. After having allowed to stand, solid image was printed out with feeding A4 sheets in a lengthwise direction. Optical densities at a part 1 cm away from the top of the solid image and at the central part of the A4 sheet were measured with a color-difference meter "X-Rite" (commercially available from X-Rite). The difference between the optical density at the top part and the optical density at the central part, i.e. [(optical density at top part)−(optical density at the central part)], was used as an index for unevenness in optical density.

The smaller the absolute value, the more suppressed the unevenness in optical densities. The results are shown in Table 2.

In addition, the same procedures as above were carried out except that a toner of Example A9 or Comparative Example A5 or A6 was loaded to a nonmagnetic monocomponent developer device "HL-2040" (commercially available from Brother Industries, Ltd.), equipped with an organic photoconductor (OPC), and unevenness in optical density was measured. The results are shown in Table 2.

Test Example 2 [Storage Stability]

A 200 ml polyethylene bottle was charged with 10 g of a toner, and allowed to stand under the environmental conditions of 55° C. and 60% RH for 48 hours. Thereafter, the toner was sieved with a powder tester (commercially available from Hosokawa Micron Corporation) with a sieve having an opening of 75 μm at a vibration of 1 mm for 10 seconds, and an amount of toner remaining on the sieve was measured. The found value was used as an index for storage stability. The smaller the value, the more excellent the storage stability. The results are shown in Table 2.

Test Example 3 [Low-Temperature Fixing Ability]

Each of the toners of Examples A1 to A8 and Comparative Examples A1 to A4 was loaded in a nonmagnetic monocomponent developer device "OKI MICROLINE 5400" (commercially available from Oki Data Corporation). With adjusting the amount of toner adhesion to 0.50 mg/cm$^2$, a solid image of 30 mm×80 mm was printed on Xerox L sheet (A4). The solid image was taken out before passing through a fixing device, to provide an unfixed image. The resulting unfixed image was fixed with an external fixing device, which was a fixing device taken out of "OKI MICROLINE 3010" (commercially available from Oki Data Corporation), while setting the temperature of the fixing roller to 100° C. and a fixing speed to 100 mm/sec. Thereafter, the same procedures were carried out with setting the fixing roller temperature at 105° C., and raising the temperature to 200° C. in an increment of 5° C.

A plain white sheet (Xerox L sheet) was wound around a 500 g weight of which bottom had an area of 20 mm×20 mm, and placed over a portion of the solid image fixed at each temperature and reciprocated 20 time in a width of 14 cm. Thereafter, each of optical densities of the rubbed portion and the non-rubbed portion of the solid image was measured with a reflective densitometer "RD-915" (commercially available from Macbeth Process Measurements Co.), and a percentage of lowered optical density:

[Optical density of rubbed portion/Optical density of non-rubbed portion]×100 was obtained. The lowest temperature at which the percentage of the lowered optical density is 70% or more is defined as a lowest fixing temperature. The results are shown in Table 2.

In addition, the same procedures as above were carried out except that a toner of Example A9 or Comparative Example A5 or A6 was loaded to a nonmagnetic monocomponent developer device "HL-2040" (commercially available from Brother Industries, Ltd.), and the lowest fixing temperature was measured to evaluate low-temperature fixing ability. The results are shown in Table 2.

TABLE 2

| | Amorphous Resin | | | Crystalline Resin | | | Tg (° C.) of Kneaded Product | | | | |
|---|---|---|---|---|---|---|---|---|---|---|---|
| | Kind | Parts by Weight | Content of Aliphatic Diol in Alcohol Component (% by mol) | Kind | Parts by Weight | Polycondensation Resin Component/ Styrenic Resin Component (Weight Ratio) | Before Heat Treatment | After Heat Treatment | Unevenness in Optical Density | Storage Stability (g) | Low-Temp. Fixing Ability (° C.) |
| Ex. A1 | Resin a | 80 | 100 | Resin A | 20 | 81/19 | 51 | 58 | −0.03 | 0.2 | 125 |
| Ex. A2 | Resin b | 80 | 100 | Resin A | 20 | 81/19 | 52 | 58 | −0.04 | 0.2 | 130 |
| Ex. A3 | Resin a | 85 | 100 | Resin A | 15 | 81/19 | 53 | 58 | −0.03 | 0.2 | 130 |
| Ex. A4 | Resin a | 93 | 100 | Resin A | 7 | 81/19 | 55 | 59 | −0.07 | 0.1 | 140 |
| Ex. A5 | Resin a | 70 | 100 | Resin A | 30 | 81/19 | 49 | 57 | −0.05 | 0.5 | 125 |
| Ex. A6 | Resin a | 80 | 100 | Resin C | 20 | 95/5 | 50 | 57 | −0.06 | 0.4 | 125 |
| Ex. A7 | Resin a | 80 | 100 | Resin D | 20 | 62/38 | 53 | 57 | −0.05 | 0.9 | 130 |
| Ex. A8 | Resin d | 80 | 60 | Resin A | 20 | 81/19 | 49 | 57 | −0.07 | 1.0 | 130 |
| Ex. A9 | Resin f<br>Resin g | 55<br>25 | 100 | Resin E | 20 | 81/19 | 53 | 59 | −0.04 | 0.8 | 130 |
| Comp. Ex. A1 | Resin e | 80 | 0 | Resin A | 20 | 81/19 | 52 | 55 | −0.12 | 1.2 | 130 |
| Comp. Ex. A2 | Resin e | 80 | 0 | Resin B | 20 | 100/0 | 45 | 53 | −0.15 | 3.2 | 130 |
| Comp. Ex. A3 | Resin a | 80 | 100 | Resin B | 20 | 100/0 | 43 | 54 | −0.22 | 3.0 | 125 |
| Comp. Ex. A4 | Resin b | 80 | 100 | Resin B | 20 | 100/0 | 44 | 54 | −0.26 | 2.8 | 130 |
| Comp. Ex. A5 | Resin f<br>Resin g | 55<br>25 | 100 | Resin B | 20 | 100/0 | 50 | 52 | −0.16 | 3.8 | 130 |
| Comp. Ex. A6 | Resin e | 80 | 0 | Resin E | 20 | 81/19 | 52 | 55 | −0.20 | 1.4 | 130 |

As shown in Table 2, the toners of Examples A1 to A9 containing an amorphous polyester obtained from an aliphatic alcohol as a main component, and a crystalline composite resin containing a polycondensation resin component obtained by polycondensing an alcohol component containing an aliphatic diol having 2 to 10 carbon atoms, and a carboxylic acid component containing an aromatic dicarboxylic acid compound, and a styrenic resin component have suppressed unevenness in optical density, and excellent low-temperature fixing ability and storage stability, as compared to those toners of Comparative Examples A1 and A6 where an amorphous resin is an amorphous polyester obtained from an aromatic alcohol as a main component, or to those toners of Comparative Examples A3, A4, and A5 where a crystalline resin is a crystalline polyester, or the toner of Comparative Example A2 where an amorphous resin is an amorphous polyester obtained from an aromatic alcohol as a main component, and a crystalline resin is a crystalline polyester.

Examples B1 to B8 and Comparative Examples B1 to B4

An amorphous resin and a crystalline resin in given amounts listed in Table 3, 0.2 parts by weight of a negatively chargeable charge control agent "BONTRON E-304" (commercially available from Orient Chemical Co., Ltd.), 3 parts by weight of Carnauba Wax C1 (commercially available from S. Kato & CO., melting point: 88° C.), 3 parts by weight of a paraffinic wax "HNP-9" (commercially available from NIPPON SEIRO CO., LTD., melting point: 75° C.), and 4.5 parts by weight of a colorant "ECB-301" (commercially available from DAINICHISEIKA COLOR & CHEMICALS MFG. CO., LTD., phthalocyanine blue (P.B. 15:3)) were mixed with a HENSCHEL MIXER for 1 minute, and the mixture was then melt-kneaded under the following conditions.

A continuous twin open-roller type kneader "Kneadex" (commercially available from MITSUI MINING COMPANY, LIMITED, outer diameter of roller: 14 cm, effective length of roller: 80 cm) was used. The operating conditions of the continuous twin open-roller type kneader are a peripheral speed of a high-rotation roller (front roller) of 75 r/min (32.97 m/min), a peripheral speed of a low-rotation roller (back roller) of 50 r/min (21.98 m/min), and a gap between the rollers at the end part of the feeding ports of the kneaded product of 0.1 mm. The temperatures of the heating medium and the cooling medium inside the rollers are as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 10 kg/hour, and the average residence time was about 10 minutes.

The kneaded product obtained above was pressed with a cooling roller to cool it to 20° C. or lower, and the pressed product was heat-treated in an oven at 70° C. for a given time period listed in Table 3 (for 1, 3, 6, 12, and 24 hours for Examples B1 to B4 and Comparative Examples B1 to B4, and for 1 and 12 hours for Examples B5 to B8).

The heat-treated product after the heat treatment for each time period was cooled to 30° C., and the cooled product was roughly pulverized to a size of 3 mm with Rotoplex (commercially available from TOA KIKAI SEISAKUSHO). Thereafter, the roughly pulverized product was pulverized with a fluidized bed-type jet mill "AFG-400" (commercially available from HOSOKAWA ALPINE A.G.), the pulverized product was classified with a rotor-type classifier "TTSP" (commercially available from HOSOKAWA ALPINE A.G.), to provide toner matrix particles having a volume-median particle size ($D_{50}$) of 8.0 μm. To 100 parts by weight of the toner matrix particles was added 1.0 part by weight of a hydrophobic silica "RY50"(commercially available from Nippon Aerosil Co., Ltd., average particle size: 40 nm), and 0.5 parts by weight of a hydrophobic silica "R972" (commercially available from Nippon Aerosil Co., Ltd., average particle size: 16 nm) with a HENSCHEL-MIXER (commercially available from MITSUI MINING COMPANY, LIMITED) at 1500 r/min (16 m/sec) for one minute, to provide a negatively chargeable toner.

Example B9 and Comparative Example B5

An amorphous resin and a crystalline resin in given amounts listed in Table 3, positively chargeable charge control agents 3 parts by weight of "FCA-201" (commercially available from FUJIKURA KASEI CO., LTD.) and 1 part by weight of "BONTRON P-51" (commercially available from Orient Chemical Co., Ltd.), 3 parts by weight of Carnauba Wax C1 (commercially available from S. Kato & CO., melting point: 88° C.), 3 parts by weight of a paraffinic wax "HNP-9" (commercially available from NIPPON SEIRO CO., LTD., melting point: 75° C.), and 7.0 parts by weight of a colorant "ECB-301" (commercially available from DAINICHISEIKA COLOR & CHEMICALS MFG. CO., LTD., phthalocyanine blue (P.B. 15:3)) were mixed with a HENSCHEL-MIXER for 1 minute, and the mixture was then melt-kneaded under the following conditions.

A continuous twin open-roller type kneader "Kneadex" (commercially available from MITSUI MINING COMPANY, LIMITED, outer diameter of roller: 14 cm, effective length of roller: 80 cm) was used. The operating conditions of the continuous twin open-roller type kneader are a peripheral speed of a high-rotation roller (front roller) of 75 r/min (32.97 m/min), a peripheral speed of a low-rotation roller (back roller) of 50 r/min (21.98 m/min), and a gap between the rollers at the end part of the feeding ports of the kneaded product of 0.1 mm. The temperatures of the heating medium and the cooling medium inside the rollers are as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 10 kg/hour, and the average residence time was about 10 minutes.

The kneaded product obtained above was pressed with a cooling roller to cool it to 20° C. or lower, and the pressed product was heat-treated in an oven at 70° C. for a given time period listed in Table 3 (1 and 12 hours).

The heat-treated product after the heat treatment was cooled to 30° C., and the cooled product was roughly pulverized to a size of 3 mm with Rotoplex (commercially available from TOA KIKAI SEISAKUSHO). Thereafter, 1.0 part by weight of a positively chargeable silica "REA90" (commercially available from Nippon Aerosil Co., Ltd., average particle size: 20 nm) was mixed with 100 parts by weight of the roughly pulverized product with a HENSCHEL-MIXER (commercially available from MITSUI MINING COMPANY, LIMITED) at 1200 r/min for one minute, and pulverized with a fluidized bed-type jet mill "AFG-400" (commercially available from HOSOKAWA ALPINE A.G.), the pulverized product was classified with a rotor-type classifier "TTSP" (commercially available from HOSOKAWA ALPINE A.G.), to provide toner matrix particles having a volume-median particle size ($D_{50}$) of 8.0 μm. To 100 parts by weight of the toner matrix particles was added 1.0 part by weight of a hydrophobic silica "NA50H" (commercially available from Nippon Aerosil Co., Ltd., average particle size: 40 nm), and 0.5 parts by weight of a hydrophobic silica "RA200HS" (commercially available from Nippon Aerosil Co., Ltd., average particle size: 12 nm) with a HENSCHEL-MIXER (commercially available from MITSUI MINING COMPANY, LIMITED) at 1500 r/min (16 m/sec) for one minute, to provide a positively chargeable toner.

Test Example 4

Glass transition temperature and storage stability of each of the resulting toners were measured. The storage stability was evaluated in the same manner as in Test Example 2. The results are shown in Table 3.

TABLE 3

| | Amorphous Resin | | | Crystalline Resin | | | | Glass Transition Temp. (° C.) Heat Treatment Time | | | | | Storage Stability (g) Heat Treatment Time | | | | |
|---|---|---|---|---|---|---|---|---|---|---|---|---|---|---|---|---|---|
| | Kind | Parts by Weight | Content of Aliphatic Diol in Alcohol Component (% mol) | Kind | Parts by Weight | Polycondensation Resin Component/ Styrenic Resin Component (Weight Ratio) | Tg (° C.) of Kneaded Product Before Heat Treatment | 1 hr | 3 hr | 6 hr | 12 hr | 24 hr | 1 hr | 3 hr | 6 hr | 12 hr | 24 hr |
| Ex. B1 | Resin a | 80 | 100 | Resin A | 20 | 81/19 | 51 | 56 | 56 | 57 | 58 | 58 | 0.5 | 0.5 | 0.3 | 0.2 | 0.2 |
| Ex. B2 | Resin b | 80 | 100 | Resin A | 20 | 81/19 | 52 | 57 | 58 | 58 | 58 | 58 | 0.4 | 0.3 | 0.2 | 0.2 | 0.2 |
| Ex. B3 | Resin c | 80 | 100 | Resin A | 20 | 81/19 | 50 | 55 | 57 | 57 | 58 | 58 | 0.8 | 0.5 | 0.3 | 0.3 | 0.2 |
| Ex. B4 | Resin d | 80 | 60 | Resin A | 20 | 81/19 | 52 | 55 | 56 | 57 | 58 | 58 | 0.9 | 0.7 | 0.5 | 0.4 | 0.3 |
| Ex. B5 | Resin a | 93 | 100 | Resin A | 7 | 81/19 | 55 | 57 | — | — | 59 | — | 0.4 | — | — | 0.1 | — |
| Ex. B6 | Resin a | 70 | 100 | Resin A | 30 | 81/19 | 49 | 55 | — | — | 57 | — | 0.9 | — | — | 0.5 | — |
| Ex. B7 | Resin a | 80 | 100 | Resin C | 20 | 95/5 | 50 | 55 | — | — | 57 | — | 0.6 | — | — | 0.4 | — |
| Ex. B8 | Resin a | 80 | 100 | Resin D | 20 | 62/38 | 53 | 55 | — | — | 57 | — | 0.8 | — | — | 0.9 | — |
| Ex. B9 | Resin f<br>Resin g | 55<br>25 | 100 | Resin E | 20 | 81/19 | 53 | 57 | — | — | 59 | — | 1.0 | — | — | 0.8 | — |
| Comp. Ex. B1 | Resin e | 80 | 0 | Resin B | 20 | 100/0 | 45 | 46 | 49 | 52 | 53 | 55 | 8.5 | 6.5 | 4.1 | 3.2 | 1.1 |
| Comp. Ex. B2 | Resin a | 80 | 100 | Resin B | 20 | 100/0 | 43 | 46 | 48 | 51 | 54 | 56 | 9.2 | 7.9 | 4.5 | 3.0 | 0.8 |
| Comp. Ex. B3 | Resin b | 80 | 100 | Resin B | 20 | 100/0 | 44 | 47 | 49 | 52 | 54 | 56 | 8.0 | 7.3 | 4.3 | 2.8 | 0.7 |
| Comp. Ex. B4 | Resin c | 80 | 100 | Resin B | 20 | 100/0 | 42 | 45 | 48 | 51 | 53 | 55 | 9.5 | 7.5 | 3.9 | 3.3 | 0.9 |
| Comp. Ex. B5 | Resin f<br>Resin g | 55<br>25 | 100 | Resin B | 20 | 100/0 | 49 | 50 | — | — | 52 | — | 7.6 | — | — | 3.8 | — |

As shown in Table 3, the toners of Examples B1 to B9 containing an amorphous polyester obtained from an aliphatic alcohol as a main component, and a crystalline composite resin containing a polycondensation resin component and a styrenic resin component have faster recovery of Tg even with a heat treatment time as short as 1 to 6 hours, and have excellent storage stability, and excellent productivity of the toner. On the other hand, the toner of Comparative Example B1 where an amorphous resin is an amorphous polyester obtained from an aromatic alcohol as a main component, and a crystalline resin is a crystalline polyester, and the toners of Comparative Examples B2 to B5 where a crystalline resin is a crystalline polyester have delayed recovery of the crystals by the heat treatment, so that sufficient storage stability is not obtained even when the heat treatment is carried out for a long time period of from 12 to 24 h ours.

Test Example 5

The unevenness in optical density and low-temperature fixing ability were measured for the toners produced in Example B1, produced by pressing a kneaded product with a cooling roller to be cooled to 20° C. or less, and thereafter carrying out no heat treatment (0 hours), or a heat treatment for 6 hours and 12 hours. The unevenness in optical density was evaluated in the same manner as in Test Example 1, and the low-temperature fixing ability was evaluated in the same manner as in Test Example 3. The results are shown in Table 4.

TABLE 4

| | Amorphous Resin | | Crystalline Resin | | Unevenness in Optical Density | | | Low-Temp. Fixing Ability (° C.) | | |
|---|---|---|---|---|---|---|---|---|---|---|
| | Kind | Parts by Weight | Kind | Parts by Weight | Heat Treatment Time 0 hr | 6 hr | 12 hr | Heat Treatment Time 0 hr | 6 hr | 12 hr |
| Ex. B1 | Resin a | 80 | Resin A | 20 | −0.03 | −0.04 | −0.03 | 125 | 125 | 125 |

As shown in Table 4, all the toners have excellent unevenness in optical density and low-temperature fixing ability. Therefore, it can be seen that unevenness in optical density and low-temperature fixing ability are excellent regardless of the heat treatment time.

The toner of the present invention is suitably used in, for example, the development of a latent image formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner comprising a resin binder and a colorant, wherein the resin binder comprises a crystalline resin and an amorphous resin, the crystalline resin comprising a composite resin comprising:

a polycondensation resin component obtained by polycondensing an alcohol component comprising an aliphatic diol having 2 to 10 carbon atoms, and a carboxylic acid component comprising an aromatic dicarboxylic acid compound, and a styrenic resin component, and the amorphous resin comprising a polyester obtained from an alcohol component comprising an aliphatic diol in an amount of 60% by mol or more, and a carboxylic acid component.

2. The toner according to claim 1, wherein the polycondensation resin component and the styrenic resin component in the composite resin are in a weight ratio, i.e. polycondensation resin component/styrenic resin component, of from 50/50 to 95/5.

3. The toner according to claim 1, wherein the crystalline resin and the amorphous resin are in a weight ratio, i.e. crystalline resin/amorphous resin, of from 5/95 to 40/60.

4. The toner according to claim 1, wherein the composite resin is a resin obtained from polymerization of:

(i) raw material monomers for a polycondensation resin component, comprising an alcohol component comprising an aliphatic diol having 2 to 10 carbon atoms, and a carboxylic acid component comprising an aromatic dicarboxylic acid compound;

(ii) raw material monomers for a styrenic resin component; and (iii) a dually reactive monomer capable of reacting with both of the raw material monomers for a polycondensation resin component and the raw material monomers for a styrenic resin component.

5. The toner according to claim 1, obtained by the method comprising the steps of:

(1) melt-kneading at least a resin binder and a colorant to provide a kneaded product; and (2) heat-treating the kneaded product obtained in the step (1).

6. A method for producing a toner comprising the steps of:

(1) melt-kneading at least a resin binder and a colorant to provide a kneaded product; and (2) heat-treating the kneaded product obtained in the step (1), wherein the resin binder comprises a crystalline resin and an amorphous resin, the crystalline resin comprising a composite resin comprising:

a polycondensation resin component obtained by polycondensing an alcohol component comprising an aliphatic diol having 2 to 10 carbon atoms, and a carboxylic acid component comprising an aromatic dicarboxylic acid compound, and a styrenic resin component, and the amorphous resin comprising a polyester obtained from an alcohol component comprising an aliphatic diol in an amount of 60% by mol or more, and a carboxylic acid component.

* * * * *